US009915412B1

(12) United States Patent
Rashidi

(10) Patent No.: US 9,915,412 B1
(45) Date of Patent: Mar. 13, 2018

(54) LIGHT FIXTURE IN ONE OR MORE GEOMETRIC SHAPES HAVING LED ILLUMINATION OPTIONS THROUGH FRONT AND REAR PLANAR SURFACES

(71) Applicant: Hamid Rashidi, Commerce, CA (US)

(72) Inventor: Hamid Rashidi, Commerce, CA (US)

( * ) Notice: Subject to any disclaimer, the term of this patent is extended or adjusted under 35 U.S.C. 154(b) by 0 days.

(21) Appl. No.: 15/284,199

(22) Filed: Oct. 3, 2016

(51) Int. Cl.

| | |
|---|---|
| ***F21V 13/04*** | (2006.01) |
| ***F21V 7/00*** | (2006.01) |
| ***F21V 7/04*** | (2006.01) |
| *F21Y 113/13* | (2016.01) |
| *F21Y 115/10* | (2016.01) |
| *F21V 23/02* | (2006.01) |

(52) U.S. Cl.
CPC ..... *F21V 13/04* (2013.01); *F21V 7/005* (2013.01); *F21V 7/04* (2013.01); *F21V 23/026* (2013.01); *F21Y 2113/13* (2016.08); *F21Y 2115/10* (2016.08)

(58) Field of Classification Search
CPC . F21V 13/04; F21V 7/005; F21V 7/04; F21V 23/026; F21Y 2113/13; F21Y 2115/10
See application file for complete search history.

(56) References Cited

U.S. PATENT DOCUMENTS

| | | | | |
|---|---|---|---|---|
| 8,342,709 | B2 * | 1/2013 | Lueken | F21S 8/086 362/240 |
| 2008/0080189 | A1 * | 4/2008 | Wang | F21S 8/086 362/294 |

* cited by examiner

*Primary Examiner* — Mary Ellen Bowman
(74) *Attorney, Agent, or Firm* — Thomas I. Rozsa

(57) ABSTRACT

A lighting fixture which is formed in a selected geometric shape selected from the group consisting of triangular, round, oval, elliptical, rectangular, square, pentagonal, hexagonal, octagonal and polygonal having a multiplicity of sidewalls in a geometric shape and other geometric shapes which enable illumination through both or at least one of at least one exterior front planar surface and at least one exterior rear planar surface of the geometric shaped lighting fixture.

9 Claims, 26 Drawing Sheets

LIGHT FIXTURE IN ONE OR MORE GEOMETRIC SHAPES HAVING LED ILLUMINATION OPTIONS THROUGH FRONT AND REAR PLANAR SURFACES

BACKGROUND OF THE INVENTION

1. Field of the Invention

The present invention relates to the field of light fixtures and in particular, light fixtures using light emitting diode (LED) illumination including either white light LEDs or red/green/blue LEDs.

2. Description of the Prior Art

The present inventor is not aware of any prior art which would serve to disclose or make obvious the present invention. To the best of the present inventor's knowledge, the present invention is a completely new innovation and has not been created by any third party whomsoever.

SUMMARY OF THE INVENTION

The present invention is a lighting fixture which is formed in a selected geometric shape selected from the group consisting of triangular, round, oval, elliptical, rectangular, square, pentagonal, hexagonal, octagonal and polygonal having a multiplicity of exterior front planar surfaces and exterior rear planar surfaces in a geometric shape and other geometric shapes which enable illumination through at least one exterior front planar surface and/or at least one exterior rear planar surface or both at least one exterior front planar surface and at least one exterior rear planar surface. It is also within the spirit and scope of the present invention to enable the illumination to be transmitted through a multiplicity of exterior front and rear planar surfaces, with options of illumination to a selected group of exterior front planar surfaces, exterior rear planar surfaces, or both a selected group of exterior front planar surfaces and rear planar surfaces.

It is also within the spirit and scope of the present invention to provide the illumination through LEDs which can be either white light LEDs or RGB (Red, Green, Blue) LEDs. LED stands for light emitting diodes. The innovation includes having the option of having the illumination in one direction through white LEDs and illumination in an opposite direction through white LEDs; illumination in one direction through RGB LEDs and illumination in an opposite direction through RGB LEDs; illumination in one direction through white light LEDs and illumination in an opposite direction through RGB LEDs and finally, illumination in one direction through RGB LEDs and illumination in an opposite direction through white light LEDs.

It is also an object of the present invention to include a generally rectangular-shaped operating structure having elongated sidewalls housing an exterior lens, a first flat reflector retaining a first LED illumination board facing the exterior lens, an interior lens, a large generally "U"-shaped reflector retaining a second LED illumination board facing the interior lens. At least one ballast or driver is used to power the LED illumination boards. It is also within the spirit and scope of the present invention to have two ballasts or drivers to respectively power a respective one of the LED illumination boards. The driver or drivers are positioned within the housing between the two reflectors. It is also within the spirit and scope of the present invention for the first lens and the second lens to be mirror images of each other.

It is also an object of the present invention to include a generally rectangular-shaped operating structure having elongated sidewalls housing an exterior lens, a first large generally "U"-shaped reflector retaining a first illumination LED board facing the exterior lens, and a second flat reflector retaining a second LED illumination board and an interior lens, the second LED illumination board facing the interior lens. At least one ballast or driver is used to power the LED illumination boards. It is also within the spirit and scope of the present invention to have two ballasts or drivers to respectively power a respective one of the LED illumination boards. The driver or drivers are positioned within the housing between the two reflectors. It is also within the spirit and scope of the present invention for the first lens and the second lens to be mirror images of the other.

It is also within the spirit and scope of the present invention to have a fixture where there is only an LED illumination board on one of the selected reflectors, either the flat reflector or the larger generally "U"-shaped reflector, and facing either the exterior lens or the interior lens.

For the entire description, what is described as an LED illumination board, in a selected embodiment, is a printed circuit board having spaced apart LEDs affixed to the printed circuit board and the printed circuit board in turn affixed to a reflector.

It is also within the spirit and scope of the present invention to have a first printed circuit board with spaced apart white light LEDs affixed to the first printed circuit board which in turn is affixed to a flat reflector and a second printed circuit board with spaced apart white light LEDs affixed to the second printed circuit board which in turn is affixed to a large generally "U"-shaped reflector, the respective printed circuit boards and spaced apart white light LEDs facing in opposite directions.

It is additionally within the spirit and scope of the present invention to have a first printed circuit board with spaced apart RGB LEDs affixed to the first printed circuit board which in turn is affixed to a flat reflector and a second printed circuit board with spaced apart RGB LEDs affixed to the second printed circuit board which in turn is affixed to a large generally "U"-shaped reflector, the respective printed circuit boards and spaced apart RGB LEDs facing in opposite directions.

It is further within the spirit and scope of the present invention to have a first printed circuit board with spaced apart white light LEDs affixed to the first printed circuit board which in turn is affixed to a flat reflector and a second printed circuit board with spaced apart RGB LEDs affixed to the second printed circuit board which in turn is affixed to a large generally "U"-shaped reflector, the respective printed circuit boards and spaced apart white light LEDs and RGB LEDs facing in opposite directions.

It is also within the spirit and scope of the present invention to have a first printed circuit board with spaced apart RGB LEDs affixed to the first printed circuit board which in turn is affixed to a flat reflector and a second printed circuit board with spaced apart white light LEDs affixed to the second printed circuit board which in turn is affixed to a large generally "U"-shaped reflector, the respective printed circuit boards and spaced apart RGB LEDs and white light LEDs facing in opposite directions.

It is also within the spirit and scope of the present invention to have a driver included in each of the embodiments discussed above, with a driver powering both printed circuit boards. It is also within the spirit and scope of the present invention to have two drivers included in each of the embodiments discussed above, with a first driver powering one of the printed circuit boards and a second driver powering a second printed circuit board. A single driver or two drivers are retained in a space between the two reflectors. The term driver also includes the term "ballast".

It is also an object of the present invention to position the illumination operating structures within a lighting fixture having a given geometric shape so that each respective reflector with a printed circuit board affixed thereto with spaced apart LEDs affixed to the printed circuit board is positioned at selected locations along an exterior surface of the geometric shape lighting fixture or an interior surface of the geometric shape lighting fixture so that the illumination from the spaced apart LEDs extending through the lens at the specific operating structure orientation within the geometric fixture is either white light LED illumination or RGB LED illumination through one or more exterior front planar surfaces and/or rear planar surfaces of the geometric structure and white light LED illumination or RGB LED illumination through one or more exterior front planar surfaces and/o rear planar surfaces of the geometric structure. Therefore, the operating structure is retained within a geometric shape lighting fixture to provide illumination to either an exterior front planar surface or an exterior rear planar surface or both an exterior front planar surface and an exterior rear planar surface and the illumination is selected so that the illumination is white light LED illumination through both the exterior front planar surface and the exterior rear planar surface, RGB illumination through both the exterior front planar surface and rear planar surface, white light LED illumination through the exterior front planar surface and RGB illumination through the exterior rear planar surface, and finally, RGB illumination through the exterior front planar surface and white light illumination through the exterior rear planar surface. Therefore, the operating structure is oriented so that it is positioned to enable this illumination to occur through the various front and rear planar surfaces of the geometric shapes. The geometric shapes are preferably surfaces that permit a longitudinal portion into which the illumination operating structure can be inserted which would include triangular, rectangular, square and multi-sided geometric fixtures including pentagonal, hexagonal, octagonal and having a multiplicity of sidewalls in a polygonal geometric shape.

It is also an object of the present invention to include within the spirit and scope of the present invention for the utilization of the white light LED illumination source and the RGB illumination source incorporated into any other shapes which would accommodate the illumination principles as discussed above but where the illumination operating structure would have to be configured to match the geometric shape of the object into which it is inserted. For example, for a round fixture, the housing of the operating structure would be round, semi-half round, or arcuate sections to form a complete round shape. Oval, elliptical or comparable geometric shapes would have different combinations of operating structure housing shapes to match the geometric shape of the fixture.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 20 is a front elevational view of an assembled triangular lighting fixture using illumination operating structures from either FIGS. 7-9 or FIGS. 13-15 to build the three linear walls of a triangular fixture with only one set of LEDs powered to illuminate only all three exterior front planar surfaces of the illuminating operating structure, it is built with only a printed circuit board and one set of LEDs which are powered on;

FIG. 21 is a front elevational view of an assembled triangle using illumination operating structures from either FIGS. 16-18 or FIGS. 10-12 to build the three linear rear planar surfaces of a triangular fixture with only one set of LEDs powered to illuminate only all three exterior rear planar surfaces of the illuminating operating structure, it is built with only a printed circuit board and one set of LEDs which are powered on;

FIG. 22 is a front elevational view of an assembled triangular lighting fixture using illumination operating structures from either FIGS. 7-9 or FIGS. 13-15 to build the three linear walls of a triangular fixture with only one set of LEDs powered to illuminate only all three exterior front planar surfaces of the illuminating operating structure with a lens in front of the front of the exterior front planar surfaces to create a reflection illumination, it is built with only a printed circuit board and one set of LEDs which are powered on;

FIG. 25 is a front elevational view of an assembled square lighting fixture using illumination operating structures from either FIG. 16-18 or FIG. 10-12 to build the four linear walls of a square fixture with only one set of LEDs powered to illuminate only all four exterior rear planar surfaces of the illuminating operating structure, it is built with only a printed circuit board and one set of LEDs which are powered on.

DETAILED DESCRIPTION OF EMBODIMENTS OF THE PRESENT INVENTION

Figure 1:
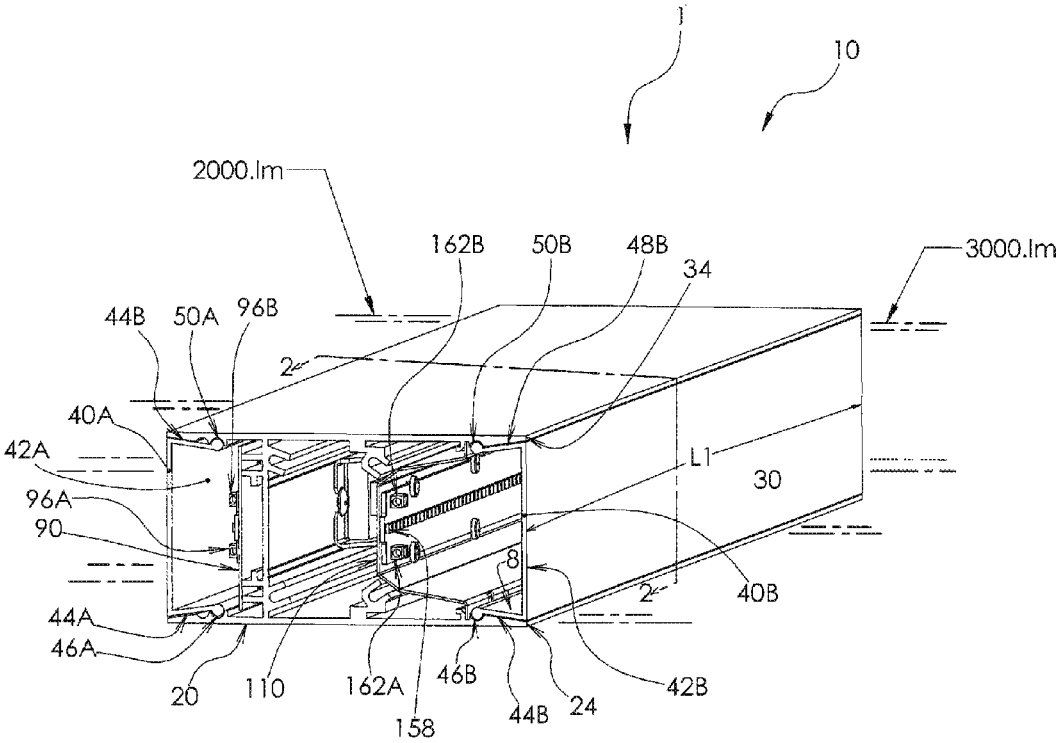
FIG. 1 is a top-right side perspective view of an illumination operating structure with a flat reflector on top, a large generally "U"-shaped reflector in an inverted configuration facing downward and illumination through both the upper lens and the lower lens.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

The present invention is a lighting fixture utilizing LEDs for illumination for exterior front planar surfaces and exterior rear planar surfaces or only exterior front planar surfaces or exterior rear planar surfaces of a geometric shaped light.

Referring to FIGS. 1-3, 7-9 and 16-18, there is illustrated one embodiment of the present invention dual reflector which enables illumination through opposite exterior front planar surfaces and exterior rear planar surfaces. In the particular embodiment illustrated in FIGS. 1-3, there is an illumination rectangular housing member 10 for one embodiment of an illumination operating structure 1. The housing member 10 is rectangular with a first sidewall 20 and a parallel oppositely disposed second sidewall 30 on opposite sides of an interior chamber 8. The first sidewall 20 has an upper end 22, a lower end 24, and an interior surface 21. The second sidewall 30 has an upper end 32, a lower end 34, and an interior sidewall 31 The first sidewall 20 has a first interiorly extending upper shelf 26A extending from interior surface 21 and the second sidewall 30 has a parallel oppositely disposed second interiorly extending upper shelf 36A extending from interior sidewall 31. A first lens 40A contains an upper illumination surface 42A through which illumination extends and a first slanted sidewall 44A which ends in a first widened retention end 46A and a second slanted sidewall 44B which ends in a second widened retention end 50A. The first lens 40A is snap fit placed within the housing so that the first slanted sidewall 44A of first lens 40A extends toward first housing sidewall 20 and the widened retention portion 46A rests upon the first interiorly extending upper shelf 26A extending from first sidewall 20 to interior surface 21. The second slanted sidewall 48B of lens 40A extends toward second housing sidewall 30 and the widened retention portion 50A rests upon the second interiorly extending upper shelf 36A extending from second sidewall 30 of interior surface 31. Therefore, the first lens 40A is snap fit retained within the interior chamber 8 of housing 10 so that the illumination surface 42A of the first lens 40A extends just slightly below the upper end 22 of first sidewall 20 and also slightly below the upper end 32 of second sidewall 30.

The housing 10 also includes a mirror image second lens 40B snap fit retained just above the lower end 24 of sidewall 20 and lower end 34 of sidewall 30. The first sidewall 20 has a first interiorly extending lower shelf 26B and the second sidewall 30 has a parallel oppositely disposed second interiorly extending lower shelf 36B. A second lens 40B contains a lower illumination surface 42B through which illumination extends and a first slanted sidewall 44B which ends in a first widened retention end 46B and a second slanted sidewall 48B which ends in a second widened retention end 50B. The second lens 40B is snap fit placed within the housing so that the first slanted sidewall 44B of second lens 40B extends toward first housing sidewall 20 and the widened retention portion 46B rests on the third interiorly extending lower shelf 26C extending from first sidewall 20 interior surface 21. The second slanted sidewall 48B of lens 40B extends toward second housing sidewall 30 and the widened retention portion 50B rests on the fourth interiorly extending lower shelf 36B extending from second sidewall 30 interior surface 31. Therefore, the second lens 40B is snap fit retained within the interior chamber 8 of housing 10 so that the illumination surface 42B of the second lens 40B extends within interior chamber 8 just slightly above the lower end 24 of first sidewall 20 and also slightly above the lower end 32 of second sidewall 30.

Also retained within the housing is a first or upper affixation transverse shelf 70 which is integrally affixed at first end 72 to first sidewall 20 and integrally affixed at second end 74 to sidewall 30. First transverse shelf 70 has an upper surface 76 and a lower surface 78. A first affixation rail 80 is integrally affixed to the upper surface 76 of first affixation transverse shelf 70 and a second affixation rail 84 is integrally affixed to the upper surface 76 of first affixation transverse shelf. Affixation rail 80 has a lengthwise groove 82 and affixation rail 84 has a lengthwise groove 86. The affixation rails 80 and 84 are parallel and spaced apart by distance "D1". The affixation shelf 70, affixation rails 80 and 84 and their respective grooves 82 and 86 extend for the entire interior length "L1" of interior chamber 8 of housing 10.

Removably affixed into grooves 82 and 86 of affixation rails 80 and 84 is a first flat reflector 90 which is affixed by a multiplicity of screws such as 81A, 81B and 81C. Removably affixed to an upper surface 92 of first flat reflector 90 is a printed circuit board 94 with a multiplicity of first set of spaced apart LEDs 98A, 98B, 98C, 98D, 98E and 98F integrally affixed to the printed circuit board 94 which is removably affixed to the upper surface 92 of first flat reflector 90 by affixation members such as screws 81A, 81B and 81C.

Figure 2:
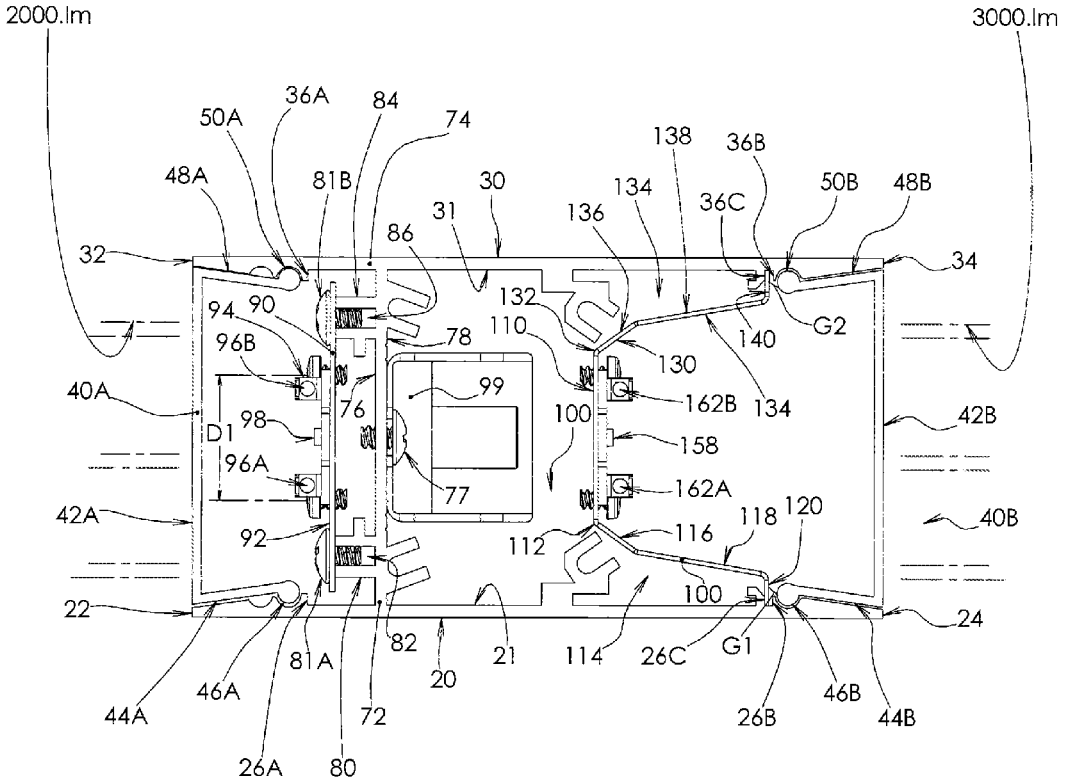
FIG. 2 is a cross-sectional view taken along line 2-2 of FIG. 1.

As illustrated in FIG. 2, at least one first ballast driver 99 is affixed to the lower surface 78 of transverse shelf 70 by affixation member 77 such as a bolt. The at least one first driver or ballast 99 is connected to a source of electric power. The at least one ballast or driver 99 is electrically connected to the printed circuit board 94 to provide power to the spaced apart LEDs 98A, 98B, 98C, 98D, 98E and 98F. Power to the printed circuit boards and first and second spaced apart LEDs is selected from the group consisting of at least one ballast retained within the interior chamber. The at least one ballast is electrically connected to the first printed circuit board and to the second printed circuit board to electrically power the first multiplicity of LEDs and the second multiplicity of LEDs. The at least one ballast is electrically connected to a source of power. Alternatively, it is within the spirit and scope of the present invention to have a first ballast and a second ballasts retained within the interior chamber with the first ballast electrically connected to the first printed circuit board to electrically power the first multiplicity of LEDs and the first ballast electrically connected to a source of power and the second ballast electrically connected to the second printed circuit board to electrically power the second multiplicity of LEDs and the second ballast electrically connected to a source of power.

Referring to the above configuration, illumination from first spaced apart LEDs travels through first lens 40A, and the LEDs are either white light LEDs or RGB LEDS.

Referring to the opposite or lower end of the housing 10, the embodiment of the second or lower lens 40B has been described. A fifth lower interior shelf 26C extends from interior surface 21 of first sidewall 20 and is just above third lower interior shelf 26B with a small gap "G1" between them. Similarly, a sixth lower interior shelf 36C extends from interior surface 31 of second sidewall 30 and is just above fourth lower interior shelf 36B with a small gap "G2" between them. The first combination third lower interior shelf 26B, first gap "G1" and fifth lower interior shelf 26C are parallel to second combination fourth lower interior shelf 36B, second gap "G2" and sixth lower interior shelf 36C.

A second reflector is a larger generally "U"-shaped reflector 100 having a transverse flat upper wall 110 with a first end 112 extending to a first leg 114 having a first leg section 116 and a second leg section 118 with a transverse end section 120 inserted and press fit retained in gap "G1". The transverse upper wall 110 has a second end 132 extending to a second leg 134 having a first leg section 136 and a second leg section 138 with a transverse end section 140 inserted and press fit retained in gap "G2". The transverse wall 110 has a lower surface 150 with a second or lower printed circuit board 160 integrally retaining a second multiplicity of spaced apart LEDs, 180A, 180B, 180C, 180D, 180E, and 180F. The printed circuit board 160 is removably affixed to the lower surface 150 of transverse wall 110 of reflector 100 by a multiplicity of affixing members such as screws by way of example 161A, 161B 161C, 161D, 161E and 161F.

Figure 6:
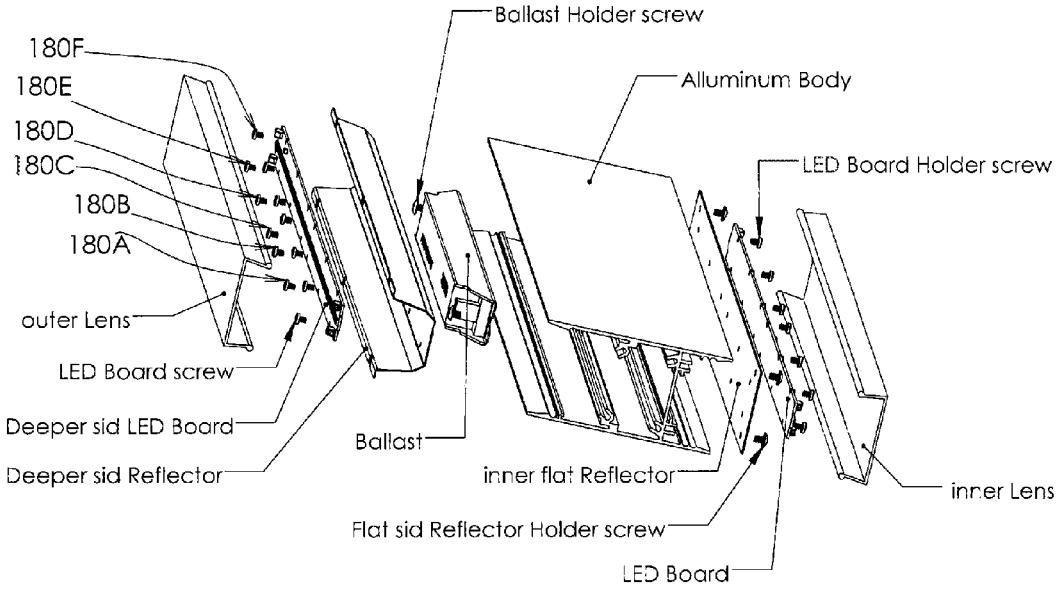
FIG. 6 is an exploded view of the illumination operating structure illustrated in FIG. 4.

Therefore second spaced LEDs 180A, 180B, 189C, 180D, 180E and 180F (see FIG. 6) face second or lower lens 40B and the printed circuit board 160 receives power from a ballast or diffuser such as 99 which in turn is connected to a source of electric power to provide power to the second multiplicity of LEDs which are either white light LEDs or RGB LEDs.

The above combination is inserted into a straight leg of a geometric shape such as a triangle or rectangle as will be later described. In the orientation described in FIGS. 1-3, the first spaced apart multiplicity of LEDs 98A, 98B, 98C, 98D, 98E, and 98F face an exterior front planar surface and the second multiplicity of spaced apart LEDs 180A, 180B, 180C, 180D, 180E and 180F face an exterior rear planar surface.

In the illustration in FIGS. 1 and 2, illumination 1000.Im is from the first set or spaced apart multiplicity of LEDs 98A, 98B, 98C, 98D, 98E, and 98F on the printed circuit board 94 affixed to flat reflector 90 facing lens 40A acting as an exterior front planar surface and illumination 2000.Im is from a second set or spaced apart multiplicity of LEDs 180A, 180B, 180C, 180D, 180E and 180F on the printed circuit boards 160 affined to generally "U"-shaped reflector 100 facing lens 40B acting as a rear planar surface.

Figure 3:
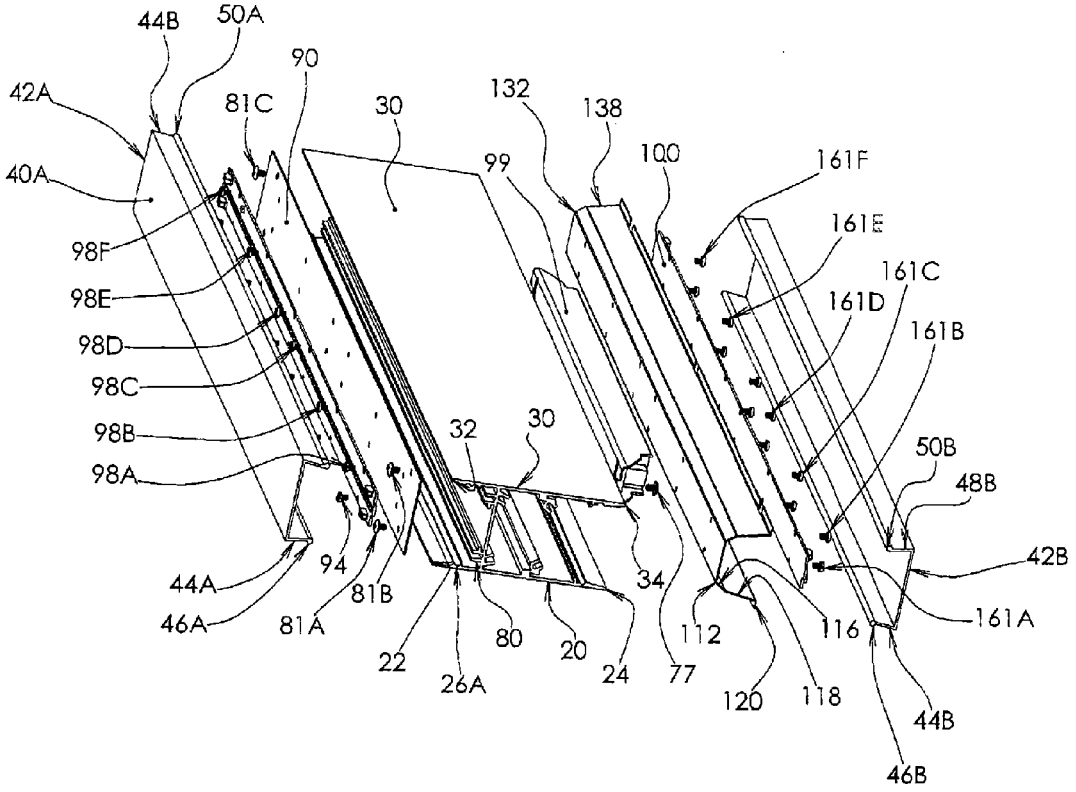
FIG. 3 is an exploded view of the illumination operating structure illustrated in FIG. 1.
Figure 7:
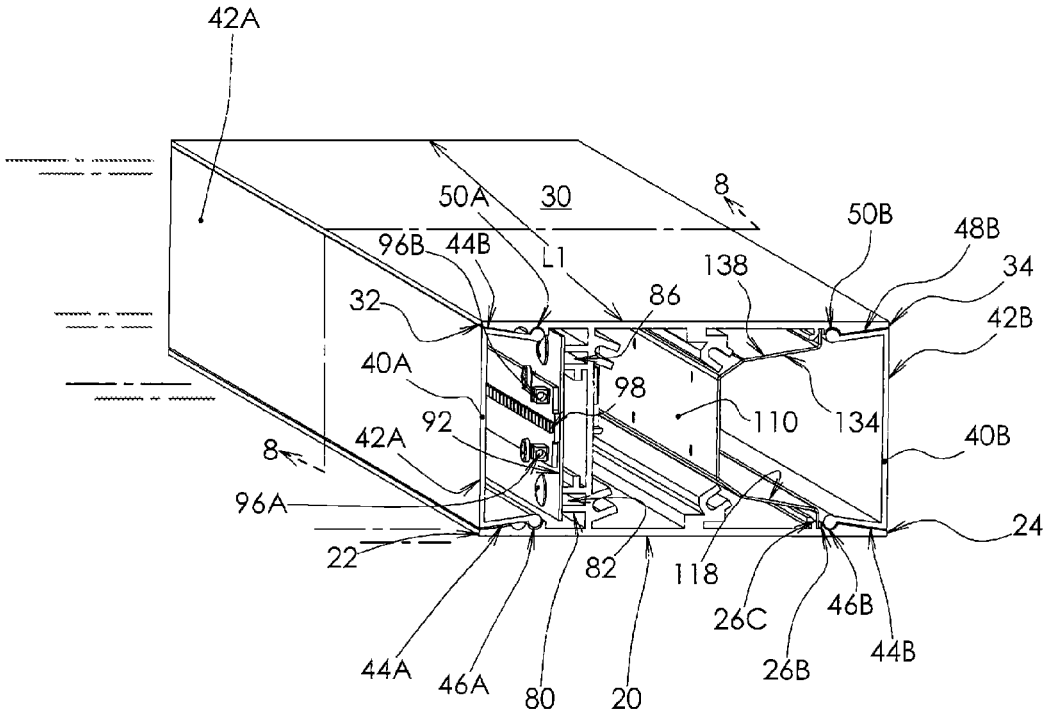
FIG. 7 is a top-right side perspective view of an illumination operating structure with a flat reflector on top, a large generally "U"-shaped reflector in an inverted configuration facing downward and illumination through the upper lens.
Figure 8:
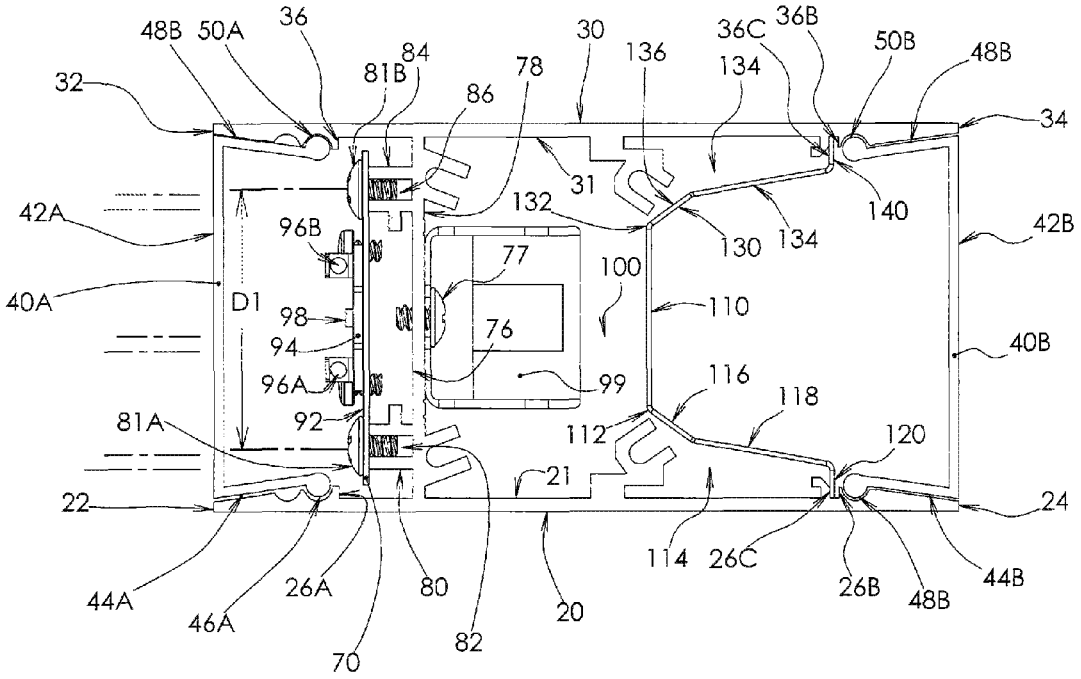
FIG. 8 is a cross-sectional view taken along line 8-8 of FIG. 7.
Figure 9:
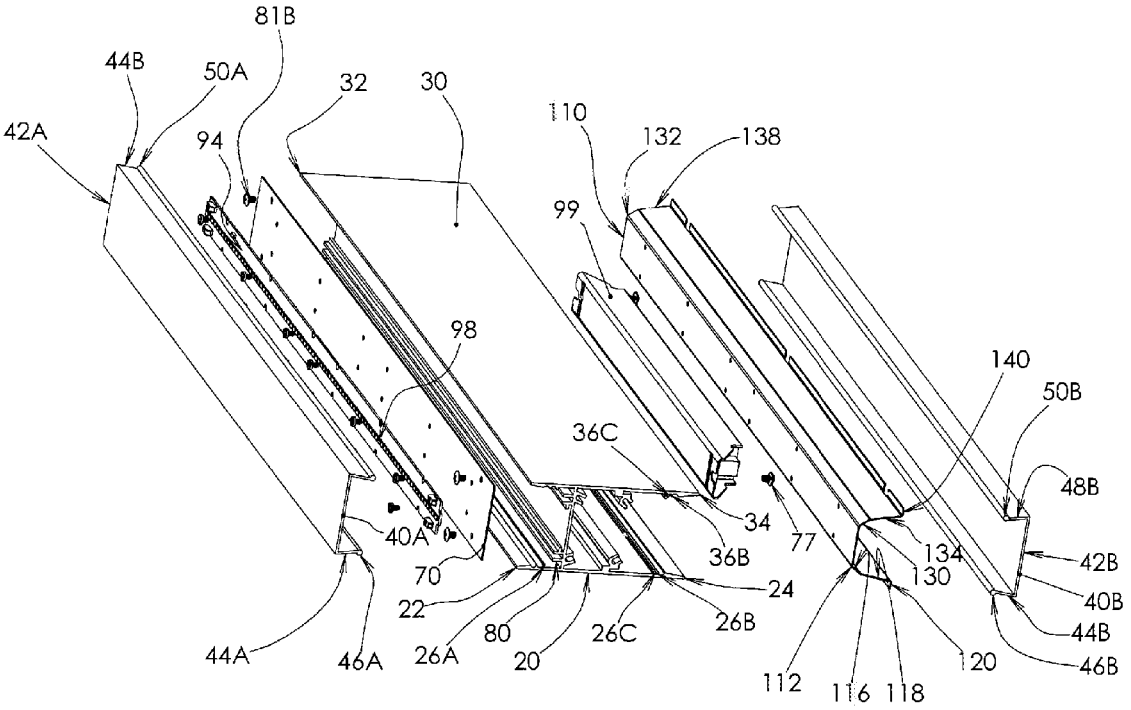
FIG. 9 is an exploded view of the illumination operating structure illustrated in FIG. 7.
Figure 16:
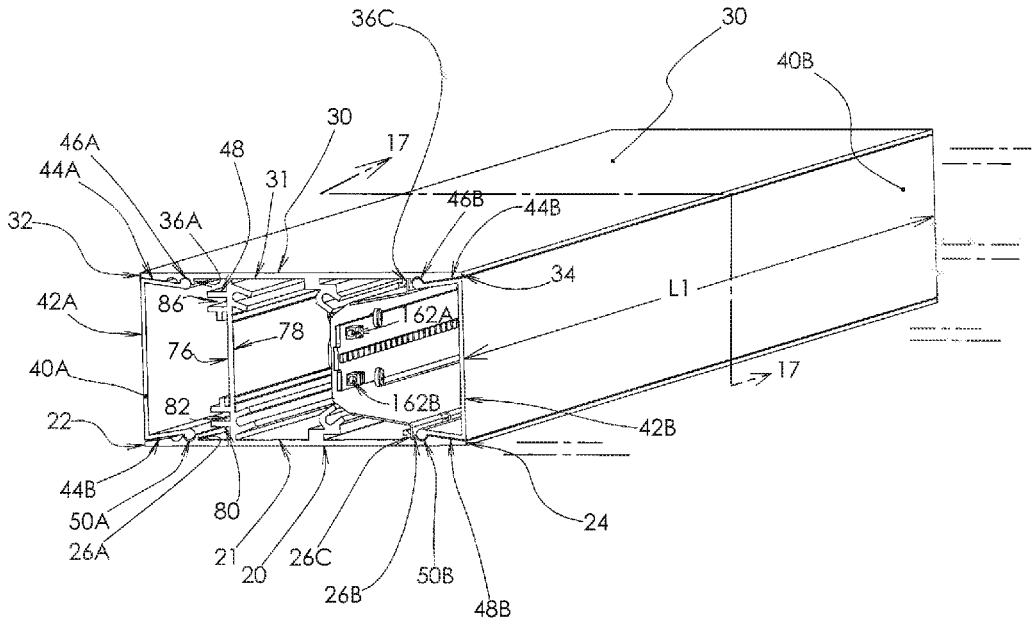
FIG. 16 is a top-right side perspective view of an illumination operating structure with a flat reflector on top, a large generally "U"-shaped reflector in an inverted configuration facing downward and illumination through the lower lens.
Figure 17:
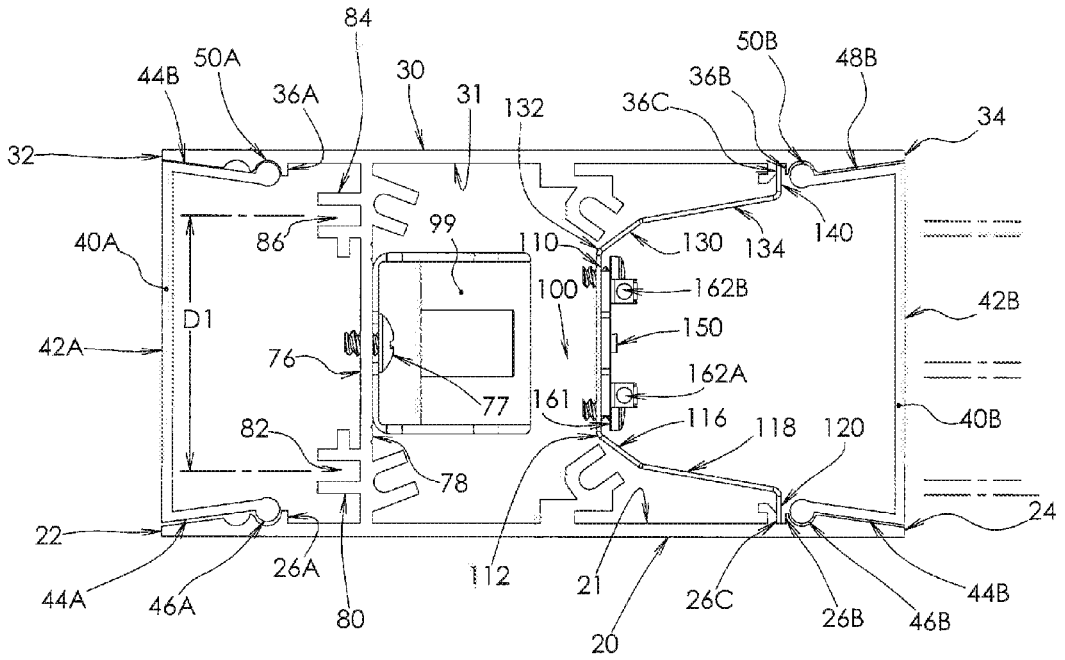
FIG. 17 is a cross-sectional view taken along line 17-17 of FIG. 16.
Figure 18:
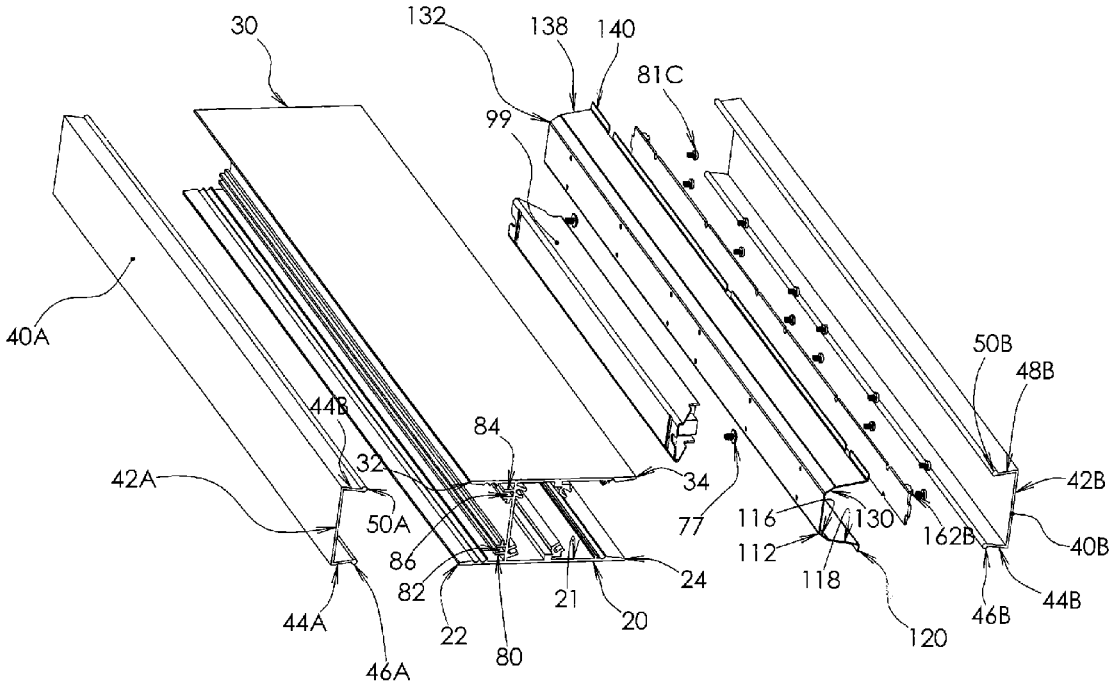
FIG. 18 is an exploded view of the illumination operating structure illustrated in FIG. 16.

In FIGS. 1 through 3, illumination from both sets of LEDs are powered and there is illumination through first lens 40A as the exterior front planar surface and the second lens 40B acting an exterior rear planar surface. In FIGS. 7 through 9, the configuration is identical to FIGS. 1 through 3, the parts are numbered the same, but only the first set of LEDs is powered and there is illumination only through first lens 40A acting as exterior front planar surface. In FIGS. 16 through 18, the configuration is identical to FIGS. 1 through 3, the parts are numbered the same, but only the second set of LEDs is powered and there is illumination only through second lens 40B acting as an exterior rear planar surface.

The following table sets forth the different ligating combinations which are achieved with the above orientation and orientation in the different subsets of illustrated Figures.

| | |
|---|---|
| I. ILLUSTRATION IN FIGURES 1-3 | |
| 1. FLAT REFLECTOR FACING EXTERIOR FRONT PLANAR SURFACE LARGE GENERALLY "U"-SHAPED REFLECTOR FACING EXTERIOR REAR PLANAR SURFACE | |
| EXTERIOR FRONT PLANAR SURFACE | WHITE LIGHT LEDs ON FLAT REFLECTOR |
| EXTERIOR REAR PLANAR SURFACE | WHITE LIGHT LEDS ON LARGE GENERALLY "U"-SHAPED REFLECTOR |

-continued

ILLUMINATION THROUGH BOTH EXTERIOR FRONT PLANAR SURFACES AND EXTERIOR REAR PLANAR SURFACES.

2. FLAT REFLECTOR FACING EXTERIOR FRONT PLANAR SURFACES LARGE GENERALLY "U"-SHAPED REFLECTOR FACING EXTERIOR REAR PLANAR SURFACES

EXTERIOR FRONT PLANAR SURFACE RGB LIGHT LEDs ON FLAT REFLECTOR
EXTERIOR REAR PLANAR SURFACES RGB LIGHT LEDS ON LARGER GENERALLY "U"-SHAPED REFLECTOR

ILLUMINATION THROUGH BOTH EXTERIOR FRONT PLANAR SURFACES AND EXTERIOR REAR PLANAR SURFACES.

3. FLAT REFLECTOR FACING EXTERIOR FRONT PLANAR SURFACES LARGE GENERALLY "U"-SHAPED REFLECTOR FACING EXTERIOR REAR PLANAR SURFACES

EXTERIOR FRONT PLANAR SURFACE WHITE LIGHT LEDs ON FLAT REFLECTOR
EXTERIOR REAR PLANAR SURFACE RGB LEDS ON LARGE GENERALLY "U"-SHAPED REFLECTOR

ILLUMINATION THROUGH BOTH EXTERIOR FRONT PLANAR SURFACES AND EXTERIOR REAR PLANAR SURFACES.

4. FLAT REFLECTOR FACING EXTERIOR FRONT PLANAR SURFACES LARGE GENERALLY "U"-SHAPED REFLECTOR FACING EXTERIOR REAR PLANAR SURFACES

EXTERIOR FRONT PLANAR SURFACES RGB LEDs ON FLAT REFLECTOR
EXTERIOR REAR PLANAR SURFACES WHITE LIGHT LEDs ON LARGE GENERALLY "U"-SHAPED REFLECTOR

ILLUMINATION THROUGH BOTH EXTERIOR FRONT PLANAR SURFACES AND EXTERIOR REAR PLANAR SURFACES.

II. ILLUSTRATION IN FIGURES 7-9

1. FLAT REFLECTOR FACING EXTERIOR FRONT PLANAR SURFACE LARGE GENERALLY "U"-SHAPED REFLECTOR FACING EXTERIOR REAR PLANAR SURFACE

EXTERIOR FRONT PLANAR SURFACE WHITE LIGHT LEDs ON FLAT REFLECTOR EXTERIOR REAR PLANAR SURFACE
WHITE LIGHT LEDS ON LARGE GENERALLY "U"-SHAPED REFLECTOR OR NO LEDs

ILLUMINATION ONLY THROUGH EXTERIOR FRONT PLANAR SURFACES.

2. FLAT REFLECTOR FACING EXTERIOR FRONT PLANAR SURFACES LARGE GENERALLY "U"-SHAPED REFLECTOR FACING EXTERIOR REAR PLANAR SURFACES

EXTERIOR FRONT PLANAR SURFACE RGB LIGHT LEDs ON FLAT REFLECTOR
EXTERIOR REAR PLANAR SURFACES RGB LIGHT LEDS ON LARGE GENERALLY "U"-SHAPED REFLECTOR OR NO LEDs

ILLUMINATION THROUGH ONLY EXTERIOR FRONT PLANAR SURFACES

3. FLAT REFLECTOR FACING EXTERIOR FRONT PLANAR SURFACES LARGE GENERALLY "U"-SHAPED REFLECTOR FACING EXTERIOR REAR PLANAR SURFACES

EXTERIOR FRONT PLANAR SURFACE WHITE LIGHT LEDs ON FLAT REFLECTOR
EXTERIOR REAR PLANAR SURFACE RGB LEDS ON LARGE GENERALLY "U"-SHAPED REFLECTOR OR NO LEDs

ILLUMINATION THROUGH ONLY EXTERIOR FRONT PLANAR SURFACES.

4. FLAT REFLECTOR FACING EXTERIOR FRONT PLANAR SURFACES LARGE GENERALLY "U"-SHAPED REFLECTOR FACING EXTERIOR REAR PLANAR SURFACES

EXTERIOR FRONT PLANAR SURFACES RGB LEDs ON FLAT REFLECTOR
EXTERIOR REAR PLANAR SURFACES WHITE LIGHT LEDs ON LARGE GENERALLY "U"-SHAPED REFLECTOR OR NO LEDs

ILLUMINATION THROUGH ONLY EXTERIOR FRONT PLANAR SURFACES

III. ILLUSTRATION IN FIGURES 16-18

FLAT REFLECTOR FACING EXTERIOR FRONT PLANAR SURFACE LARGE GENERALLY "U"-SHAPED REFLECTOR FACING EXTERIOR REAR PLANAR SURFACE

EXTERIOR FRONT PLANAR SURFACE WHITE LIGHT LEDs ON FLAT REFLECTOR OR NO LEDs
EXTERIOR REAR PLANAR SURFACE WHITE LIGHT LEDS ON LARGE GENERALLY "U"-SHAPED REFLECTOR

ILLUMINATION THROUGH ONLY EXTERIOR REAR PLANAR SURFACES.

2. FLAT REFLECTOR FACING EXTERIOR FRONT PLANAR SURFACES LARGE GENERALLY "U"-SHAPED REFLECTOR FACING EXTERIOR REAR PLANAR SURFACES

-continued

| | |
|---|---|
| EXTERIOR FRONT PLANAR SURFACE | RGB LIGHT LEDs ON FLAT REFLECTOR OR NO LEDs |
| EXTERIOR REAR PLANAR SURFACES | RGB LIGHT LEDS ON LARGE GENERALLY "U"-SHAPED REFLECTOR |
| ILLUMINATION THROUGH ONLY EXTERIOR REAR PLANAR SURFACES. | |
| 3. FLAT REFLECTOR FACING EXTERIOR FRONT PLANAR SURFACES LARGE GENERALLY "U"-SHAPED REFLECTOR FACING EXTERIOR REAR PLANAR SURFACES | |
| EXTERIOR FRONT PLANAR SURFACE | WHITE LIGHT LEDs ON FLAT REFLECTOR OR NO LEDs |
| EXTERIOR REAR PLANAR SURFACE | RGB LEDS ON LARGE GENERALLY "U"-SHAPED REFLECTOR |
| ILLUMINATION THROUGH ONLY EXTERIOR REAR PLANAR SURFACES. | |
| 4. FLAT REFLECTOR FACING EXTERIOR FRONT PLANAR SURFACES LARGE GENERALLY "U"-SHAPED REFLECTOR FACES EXTERIOR REAR PLANAR SURFACE | |
| EXTERIOR FRONT PLANAR SURFACES | RGB LEDs ON FLAT REFLECTOR OR NO LEDs |
| EXTERIOR REAR PLANAR SURFACES | WHITE LIGHT LEDs ON LARGE GENERALLY "U"-SHAPED REFLECTOR |
| ILLUMINATION THROUGH ONLY REAR PLANAR SURFACES. | |

Figure 4:
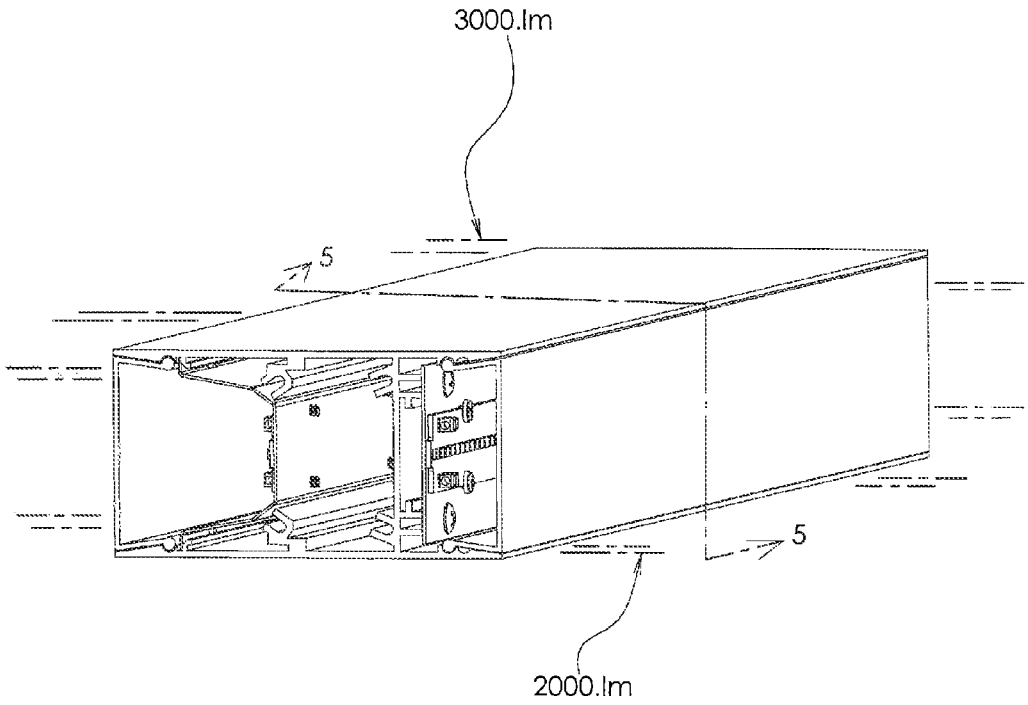
FIG. 4 is a top-right side perspective view of an illumination operating structure with a large generally "U"-shaped reflector facing upward and a flat illumination reflector as a lower reflector, and illumination through both the upper lens and the lower lens.
Figure 5:
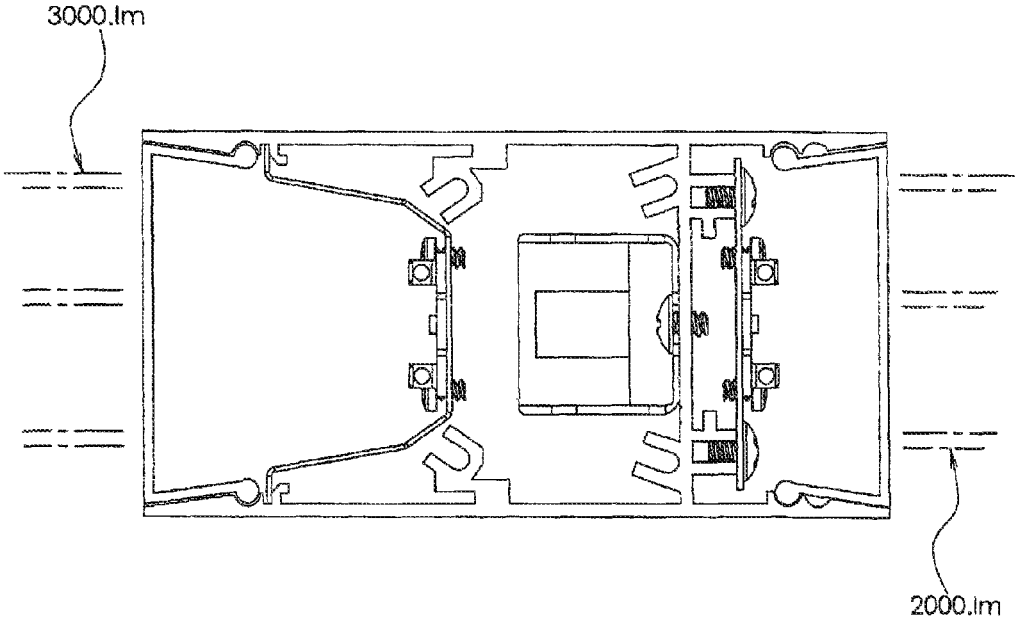
FIG. 5 is a cross-sectional view taken along line 5-5 of FIG. 4.
Figure 10:
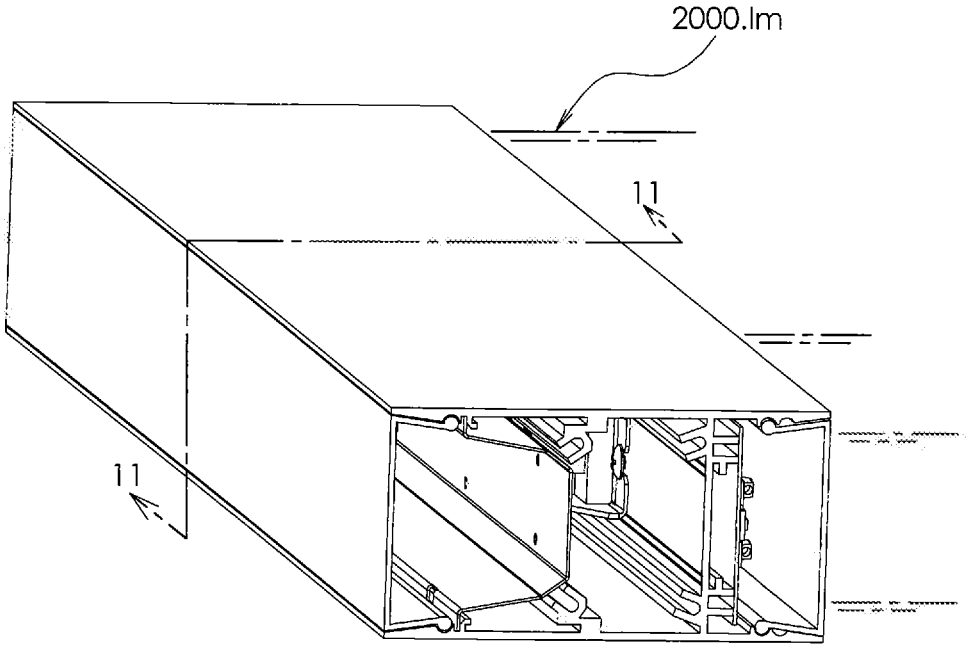
FIG. 10 is a top-right side perspective view of an illumination operating structure with a large generally "U"-shaped reflector facing upward and a flat illumination reflector as a lower reflector, and illumination through only the lower lens.
Figure 11:
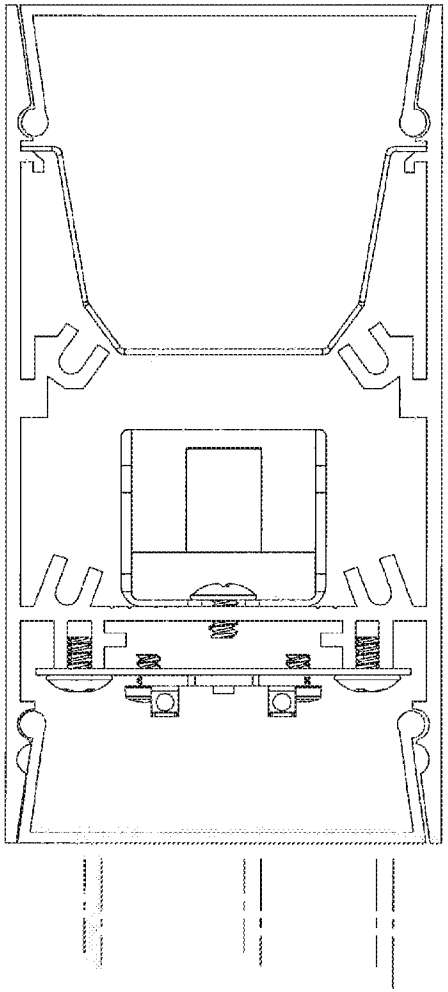
FIG. 11 is a cross-sectional view taken along line 11-11 of FIG. 10.
Figure 12:
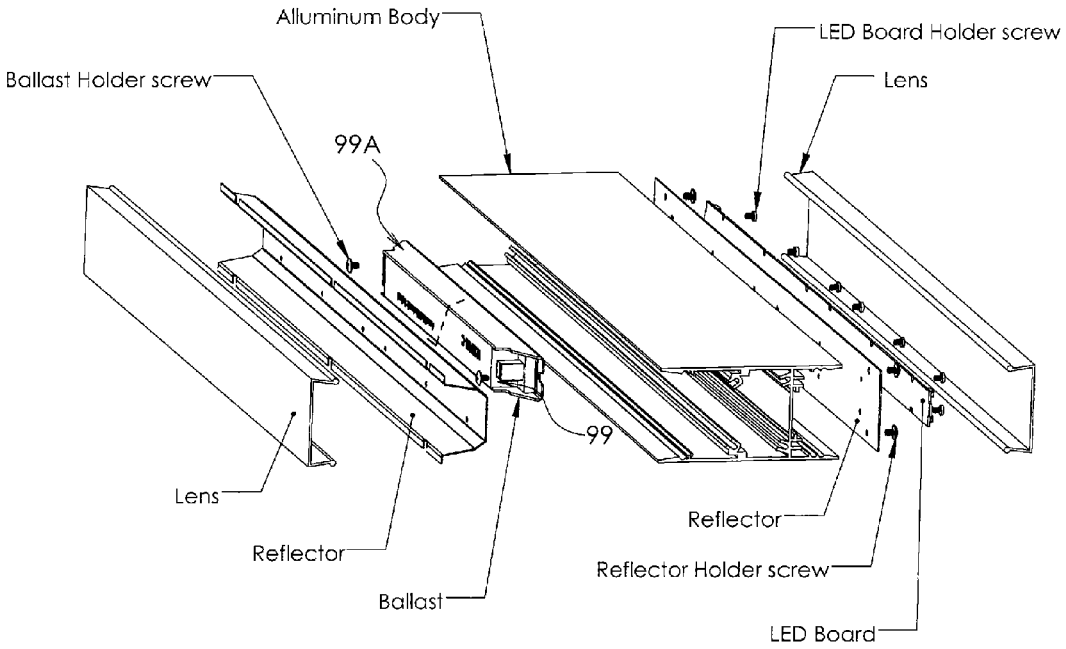
FIG. 12 is an exploded view of the illumination operating structure illustrated in FIG. 10.
Figure 13:
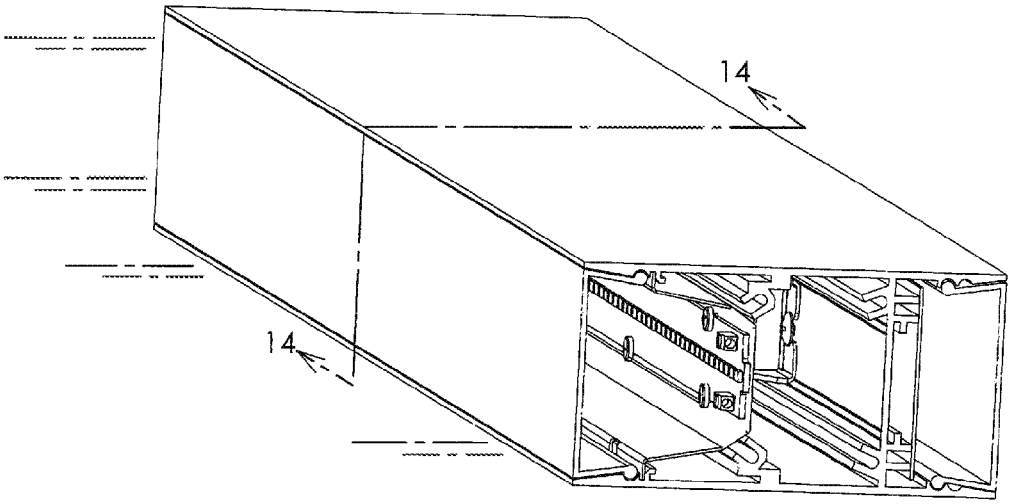
FIG. 13 is a top-right side perspective view of an illumination operating structure with a large generally "U"-shaped reflector facing upward and a flat illumination reflector as a lower reflector, and illumination through only the upper lens.
Figure 14:
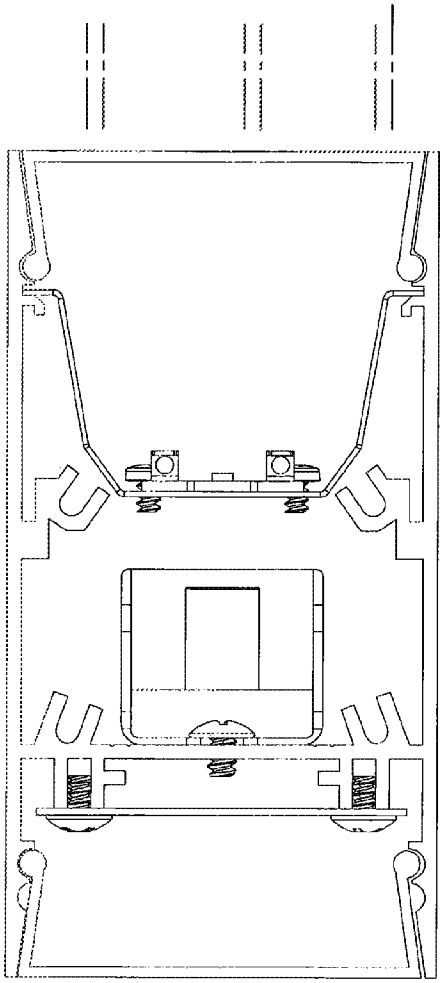
FIG. 14 is a cross-sectional view taken along line 14-14 of FIG. 13.
Figure 15:
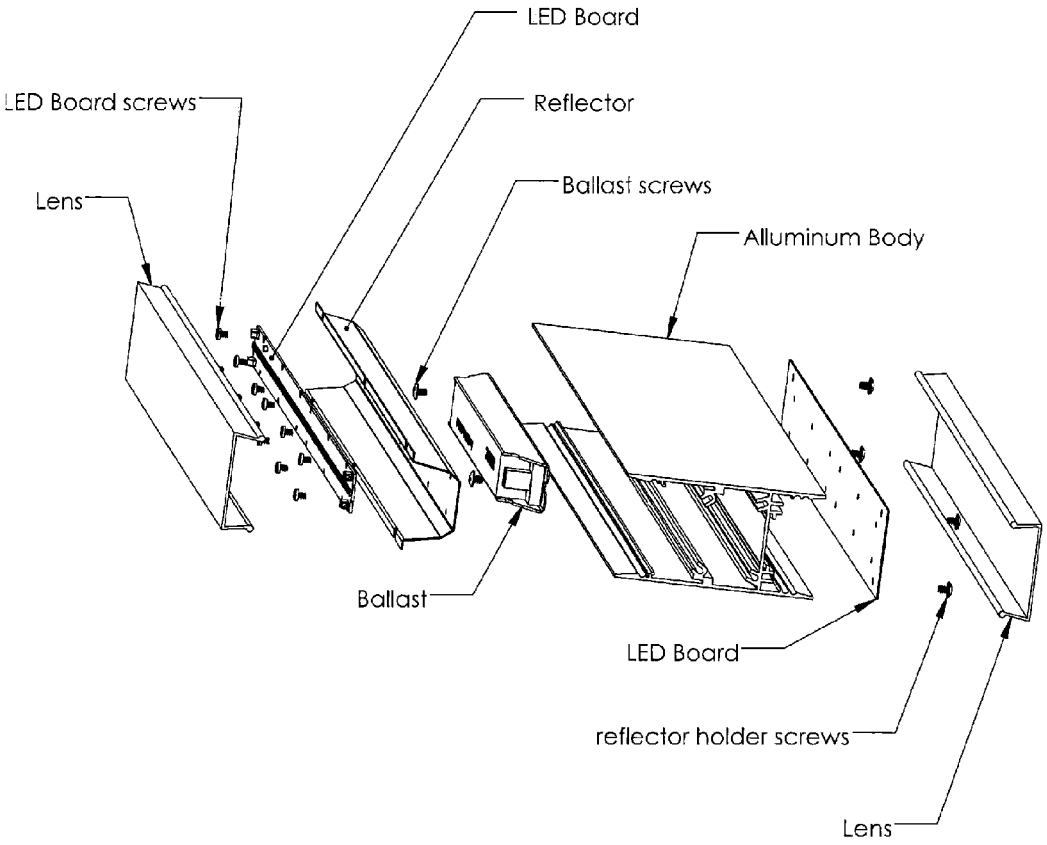
FIG. 15 is an exploded view of the illumination operating structure illustrated in FIG. 13.

The orientation illustrated in FIGS. 1 through 3, 7 through 9 and 16 through 18 can be reversed by rotating the housing 10 by 180 degrees either clockwise or counterclockwise. The result is that the flat reflector 90 and lens 40A respectively become the lower reflector and lower lens illuminating an exterior rear planar surface and large generally "U"-shaped reflector 100 and lens 40B respectively become the upper reflector and upper lens illuminating an exterior front planar sidewall. In the inverted orientation, the illustrations from FIGS. 1-3 are illustration in FIG. 4-6; illustrations from FIGS. 7-9 are illustrated in FIGS. 13 through 15, and illustrations from 16 through 18 are illustrated in FIGS. 10 through 12. In FIG. 12, there is illustrated a first ballast 99 and a second ballast 99A.

In the illustrations the parts are numbered exactly the same as the Figures from which they correspond

| | |
|---|---|
| IV. ILLUSTRATION IN FIGURES 4-6 | |
| I. FLAT REFLECTOR FACING EXTERIOR REAR PLANAR SURFACE LARGE GENERALLY "U"-SHAPED REFLECTOR FACING EXTERIOR FRONT PLANAR | |
| 2. FLAT REFLECTOR FACING EXTERIOR REAR PLANAR SURFACE LARGE GENERALLY "U"-SHAPED REFLECTOR FACING EXTERIOR FRONT PLANARSURFACE | |
| EXTERIOR REAR PLANAR SURFACE | WHITE LIGHT LEDs ON FLAT REFLECTOR |
| EXTERIOR FRONT PLANAR SURFACE | WHITE LIGHT LEDS ON LARGE GENERALLY "U"-SHAPED REFLECTOR |
| ILLUMINATION THROUGH BOTH EXTERIOR FRONT PLANAR SURFACES AND EXTERIOR REAR PLANAR SURFACES. | |
| 2. FLAT REFLECTOR FACING EXTERIOR REAR PLANAR SURFACES LARGE GENERALLY "U"-SHAPED REFLECTOR FACING EXTERIOR FRONT PLANAR SURFACES | |
| EXTERIOR REAR PLANAR SURFACE | RGB LIGHT LEDs ON FLAT REFLECTOR |
| EXTERIOR FRONT PLANAR SURFACES | RGB LIGHT LEDS ON LARGE GENERALLY "U"-SHAPED REFLECTOR |
| ILLUMINATION THROUGH BOTH EXTERIOR FRONT PLANAR SURFACES AND EXTERIOR REAR PLANAR SURFACES. | |
| 3. FLAT REFLECTOR FACING EXTERIOR REAR PLANAR SURFACES LARGE GENERALLY "U"-SHAPED REFLECTOR FACING EXTERIOR FRONT PLANAR SURFACES | |
| EXTERIOR REAR PLANAR SURFACE | WHITE LIGHT LEDs ON FLAT REFLECTOR |
| EXTERIOR FRONT PLANAR SURFACE | RGB LEDS ON LARGE GENERALLY "U"-SHAPED REFLECTOR |
| ILLUMINATION THROUGH BOTH EXTERIOR FRONT PLANAR SURFACES AND EXTERIOR REAR PLANAR SURFACES. | |
| 4. FLAT REFLECTOR FACING EXTERIOR REAR PLANAR SURFACES LARGE GENERALLY "U"-SHAPED REFLECTOR FACING EXTERIOR FRONT PLANAR SURFACE | |
| EXTERIOR REAR PLANAR SURFACES | RGB LEDs ON FLAT REFLECTOR |
| EXTERIOR FRONT PLANAR SURFACES | WHITE LIGHT LEDs ON LARGE GENERALLY "U"-SHAPED REFLECTOR |

-continued

ILLUMINATION THROUGH BOTH EXTERIOR FRONT PLANAR SURFACES AND EXTERIOR REAR PLANAR SURFACES.

V. ILLUMINATION IN FIGURES 12-15

1. FLAT REFLECTOR FACING EXTERIOR REAR PLANAR SURFACE LARGE GENERALLY "U"-SHAPED REFLECTOR FACING EXTERIOR FRONT PLANAR SURFACE

| | |
|---|---|
| EXTERIOR REAR PLANAR SURFACE | WHITE LIGHT LEDs ON FLAT REFLECTOR OR NO LEDs |
| EXTERIOR FRONT PLANAR SURFACE | WHITE LIGHT LEDS ON LARGE GENERALLY "U"-SHAPED REFLECTOR |

ILLUMINATION ONLY THROUGH EXTERIOR FRONT PLANAR SURFACES.

2. FLAT REFLECTOR FACING EXTERIOR REAR PLANAR SURFACES LARGE GENERALLY "U"-SHAPED REFLECTOR FACING EXTERIOR FRONT PLANAR SURFACES

| | |
|---|---|
| EXTERIOR REAR PLANAR SURFACE | RGB LIGHT LEDs ON FLAT REFLECTOR OR NO LEDs |
| EXTERIOR FRONT PLANAR SURFACES | RGB LIGHT LEDS ON LARGE GENERALLY "U"-SHAPED REFLECTOR |

ILLUMINATION THROUGH ONLY EXTERIOR FRONT PLANAR SURFACES

3. FLAT REFLECTOR FACING EXTERIOR REAR PLANAR SURFACES LARGE GENERALLY "U"-SHAPED REFLECTOR FACING EXTERIOR FRONT PLANAR SURFACES

| | |
|---|---|
| EXTERIOR REAR PLANAR SURFACE | WHITE LIGHT LEDs ON FLAT REFLECTOR OR NO LEDs |
| EXTERIOR FRONT PLANAR SURFACE | RGB LEDS ON LARGE GENERALLY "U"-SHAPED REFLECTOR |

ILLUMINATION THROUGH ONLY EXTERIOR FRONT PLANAR SURFACES.

4. FLAT REFLECTOR FACING EXTERIOR REAR PLANAR SURFACES LARGE GENERALLY "U"-SHAPED REFLECTOR FACES EXTERIOR FRONT PLANAR SURFACE

| | |
|---|---|
| EXTERIOR REAR PLANAR SURFACES | RGB LEDs ON FLAT REFLECTOR OR NO LEDs |
| EXTERIOR FRONT PLANAR SURFACES | WHITE LIGHT LEDs ON LARGE GENERALLY "U"-SHAPED REFLECTOR |

ILLUMINATION THROUGH ONLY EXTERIOR FRONT PLANAR SURFACES

VI. ILLUSTRATION IN FIGURES 10-12

FLAT REFLECTOR FACING EXTERIOR REAR PLANAR SURFACE LARGE GENERALLY "U"-SHAPED REFLECTOR FACING EXTERIOR FRONT PLANAR SURFACE

| | |
|---|---|
| EXTERIOR REAR PLANAR SURFACE | WHITE LIGHT LEDs ON FLAT REFLECTOR |
| EXTERIOR FRONT PLANAR SURFACE | WHITE LIGHT LEDS ON LARGE GENERALLY "U"-SHAPED REFLECTOR OR NO LEDs |

ILLUMINATION THROUGH ONLY EXTERIOR REAR PLANAR SURFACES.

2. FLAT REFLECTOR FACING EXTERIOR REAR PLANAR SURFACES LARGE GENERALLY "U"-SHAPED REFLECTOR FACING EXTERIOR FRONT PLANAR SURFACES

| | |
|---|---|
| EXTERIOR REAR PLANAR SURFACE | RGB LIGHT LEDs ON FLAT REFLECTOR |
| EXTERIOR FRONT PLANAR SURFACES | RGB LIGHT LEDS ON LARGE GENERALLY "U"-SHAPED REFLECTOR OR NO LEDs |

ILLUMINATION THROUGH ONLY EXTERIOR REAR PLANAR SURFACES.

3. FLAT REFLECTOR FACING EXTERIOR REAR PLANAR SURFACES LARGE GENERALLY "U"-SHAPED REFLECTOR FACING EXTERIOR FRONT PLANAR SURFACES

| | |
|---|---|
| EXTERIOR REAR PLANAR SURFACE | WHITE LIGHT LEDs ON FLAT REFLECTOR |
| EXTERIOR REAR PLANAR SURFACE | RGB LEDS ON LARGE GENERALLY "U"-SHAPED REFLECTOR OR NO LEDs |

ILLUMINATION THROUGH ONLY EXTERIOR REAR PLANAR SURFACES.

4. FLAT REFLECTOR FACING EXTERIOR REAR PLANAR SURFACES LARGE GENERALLY "U"-SHAPED REFLECTOR FACES EXTERIOR FRONT PLANAR SURFACE

| | |
|---|---|
| EXTERIOR REAR PLANAR SURFACES | RGB LEDs ON FLAT REFLECTOR |
| EXTERIOR FRONT PLANAR SURFACES | WHITE LIGHT LEDs ON LARGE GENERALLY "U"-SHAPED REFLECTOR OR NO LEDs |

ILLUMINATION THROUGH ONLY REAR PLANAR SURFACES.

In addition to above illumination members, the illumination member can be inserted into metric shapes. By way of example, two examples of geometric lighting fixtures built from assembling various illumination operating structures will now be described.

Figure 19:
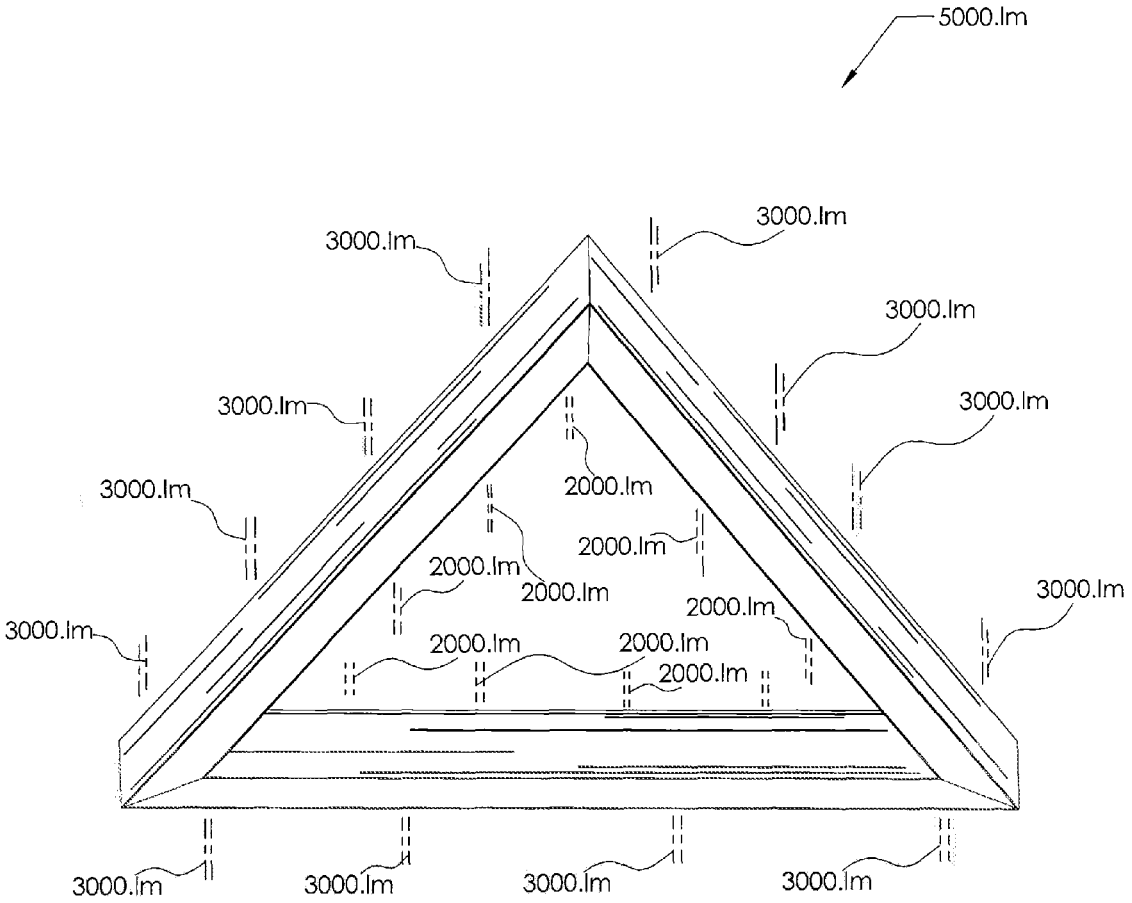
FIG. 19 is a front elevational view of an assembled triangular lighting fixture using illumination operating structures from either FIGS. 1-3 or FIGS. 4-6 to build the three linear walls of a triangular fixture with both sets of LEDs powered to illuminate both all three exterior front planar surfaces and all three rear exterior planar surfaces.

FIG. 19 is a front elevational view of an assembled triangular lighting fixture 3000 using illumination operating structures from either FIGS. 1-3 or FIGS. 4-6 to build the three linear walls of a triangular fixture with both sets of LEDs powered to illuminate both all three exterior sides with illumination 1000.Im and all three interior sides with illumination 2000.Im.

Figure 20:
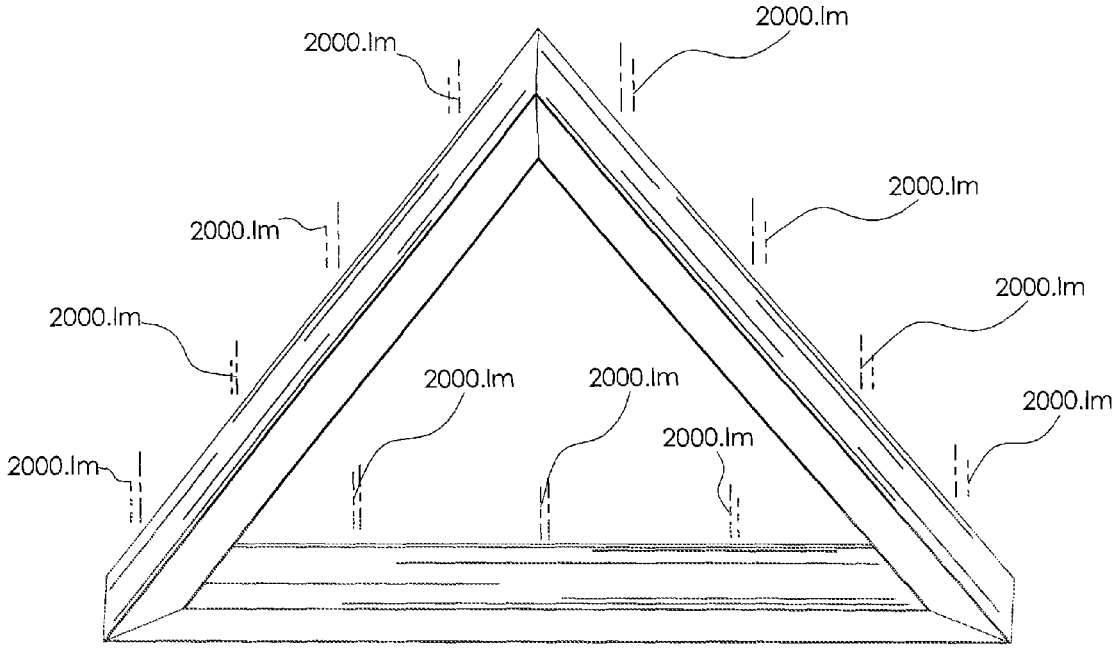
Figure 21:
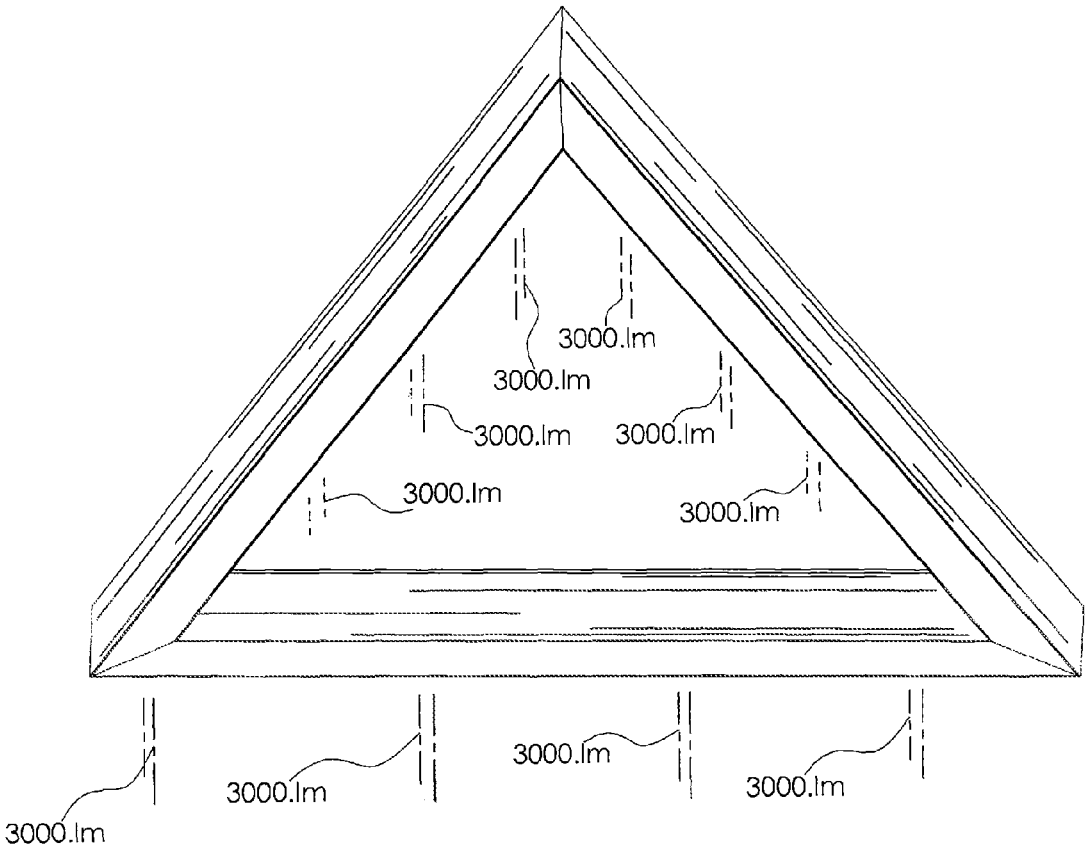
Figure 22:
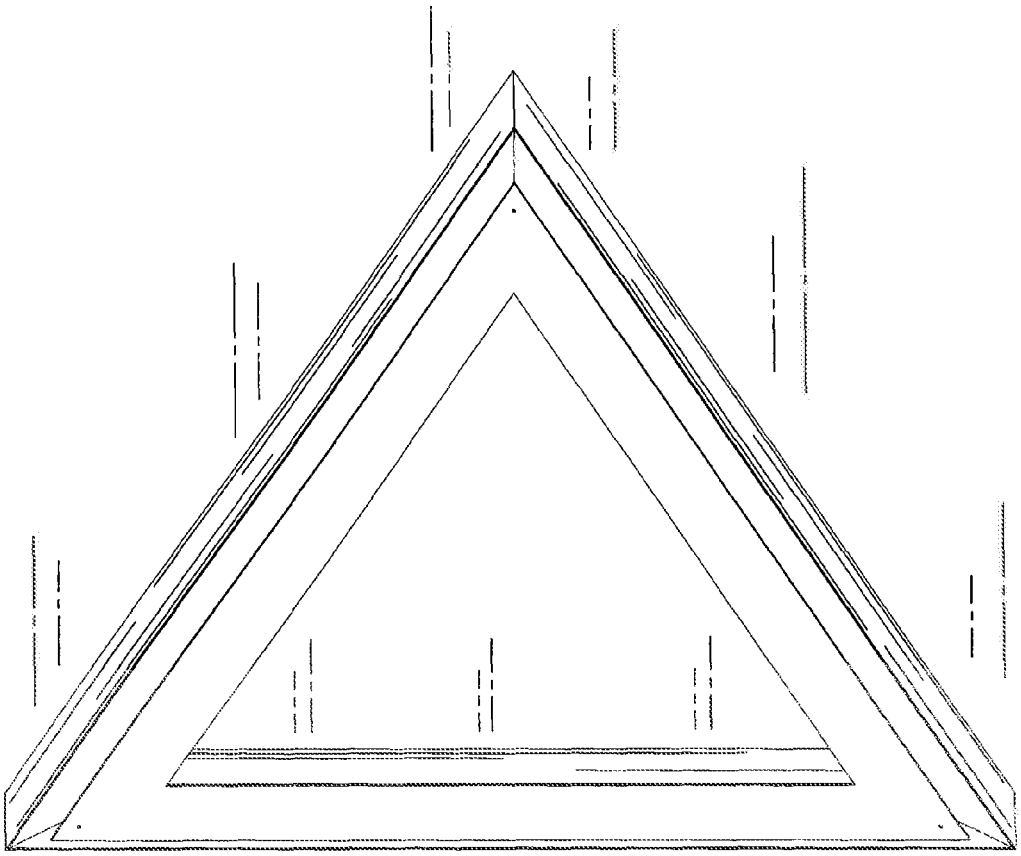
Figure 23:
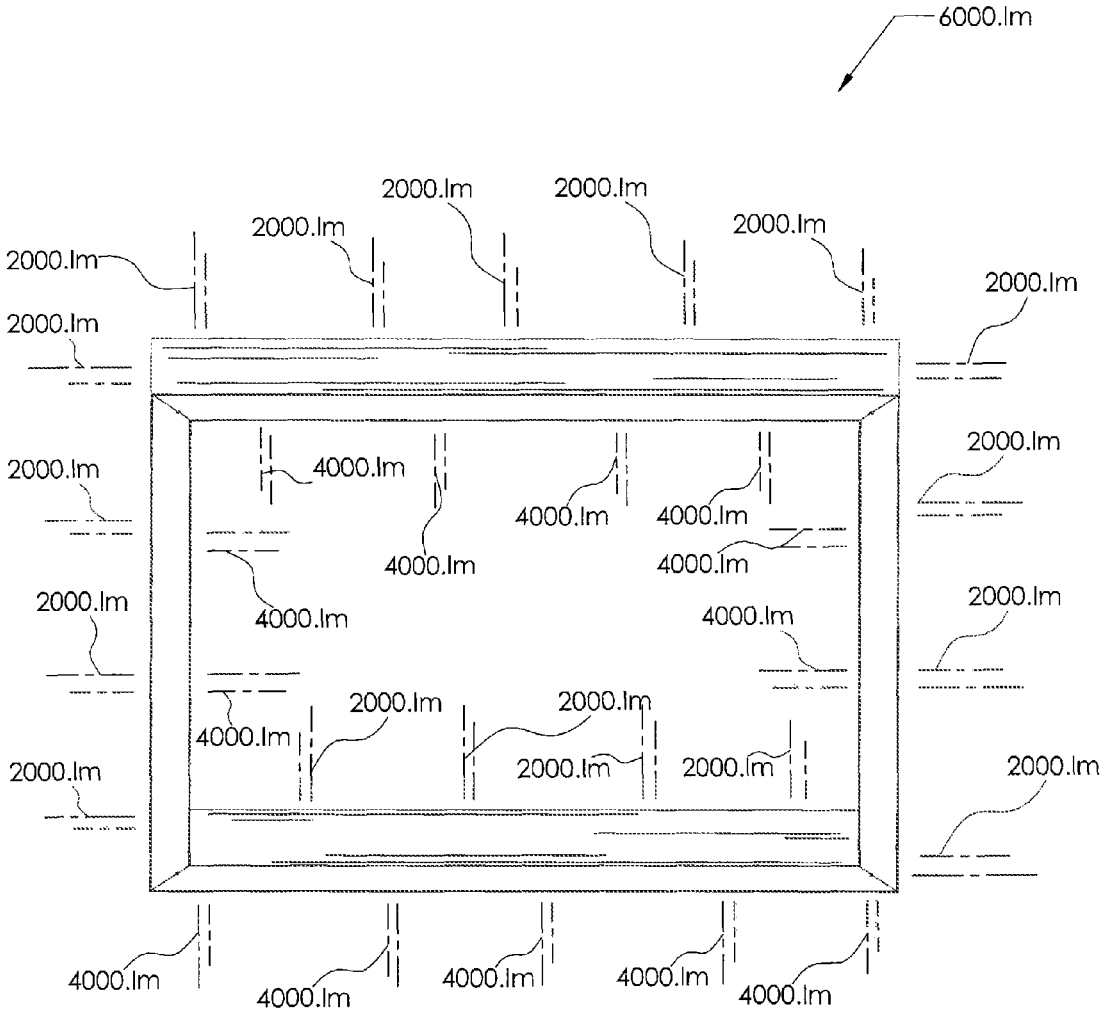
FIG. 23 is a front elevational view of an assembled square lighting fixture using illumination operating structures from either FIGS. 1-3 or FIGS. 4-6 to build the four linear walls of a square fixture with both sets of LEDs powered to illuminate both all four front exterior planar surfaces and all four exterior rear planar surfaces.
Figure 24:
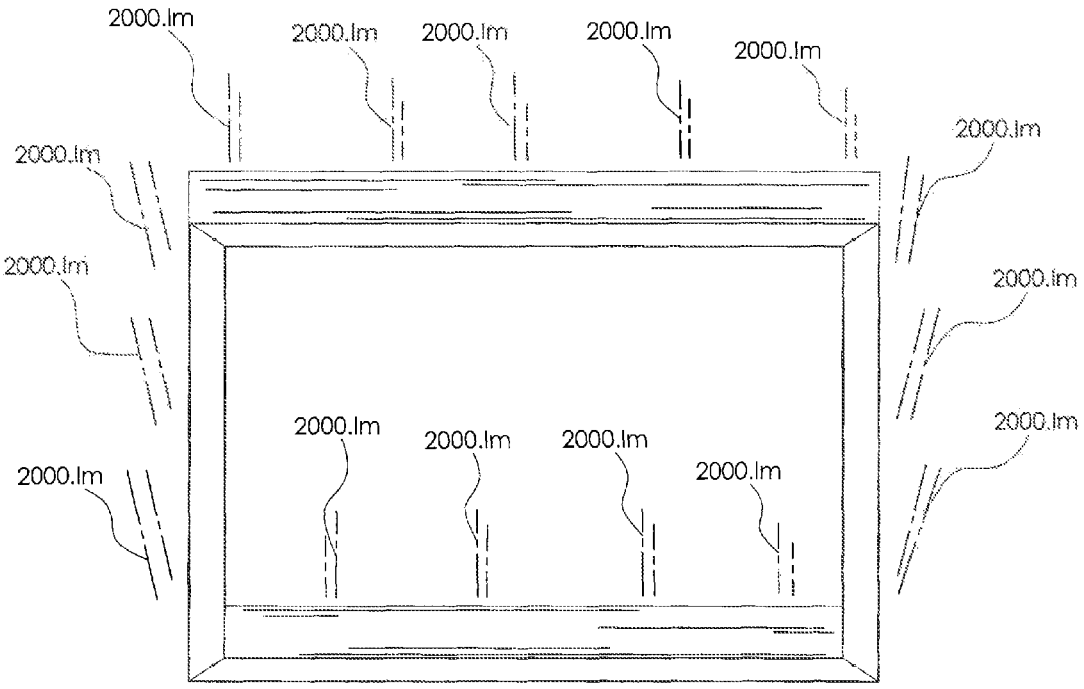
FIG. 24 is a front elevational view of an assembled square lighting fixture using illumination operating structures from either FIGS. 7-9 or FIGS. 13-15 to build the four linear walls of a square fixture with only one set of LEDs powered to illuminate only all four exterior front planar surfaces of the illuminating operating structure, it is built with only a printed circuit board and one set of LEDs which are powered on LEDs on the exterior front planar surfaces.

FIG. 20 is a front elevational view of an assembled triangular lighting fixture 3000 using illumination operating structures from either FIG. 7-9 or FIG. 13-15 to build the three linear walls of a triangular fixture with only one set of LEDs powered to illuminate only all three exterior front planar surfaces with illumination 1000.Im of the illuminating operating structure, it is built with only a printed circuit board and one set of LEDs which are powered on; LEDs on the exterior front planar surfaces; with illumination 1000.Im;

FIG. 21 is a front elevational view of an assembled triangular lighting fixture using illumination operating structures from either FIGS. 16-18 or FIGS. 10-12 to build the three linear walls of a triangular fixture 3000 with only one set of LEDs powered to illuminate only all three exterior rear planar surfaces with illumination 2000.Im of the illuminating operating structure, it is built with only a printed circuit board and one set of LEDs which are powered on; LEDs on the exterior rear planar surfaces with illumination 2000.Im;

FIG. 22 is a front elevational view of an assembled triangular lighting fixture using illumination operating structures from either FIGS. 7-9 or FIGS. 13-15 to build the three linear walls of a triangular fixture 3000 with only one set of LEDs powered to illuminate only all three exterior front planar surfaces of the illuminating operating structure with a lens in front of the front of the exterior front planar surfaces to create a reflection illumination, it is built with only a printed circuit board and one set of LEDs which are powered on;

FIG. 23 is a front elevational view of an assembled square lighting fixture using illumination operating structures from either FIGS. 1-3 or FIGS. 4-6 to build the four linear walls of a square fixture 4000 with both sets of LEDs powered to illuminate both all four front exterior planar surfaces and all four exterior rear planar surfaces;

FIG. 24 is a front elevational view of an assembled square lighting fixture using illumination operating structures from either FIGS. 7-9 or FIGS. 13-15 to build the four linear walls of a square fixture 4000 with only one set of LEDs powered to illuminate only all four exterior front planar surfaces of the illuminating operating structure, it is built with only a printed circuit board and one set of LEDs which are powered on LEDs on the exterior front planar surfaces.

Figure 25:
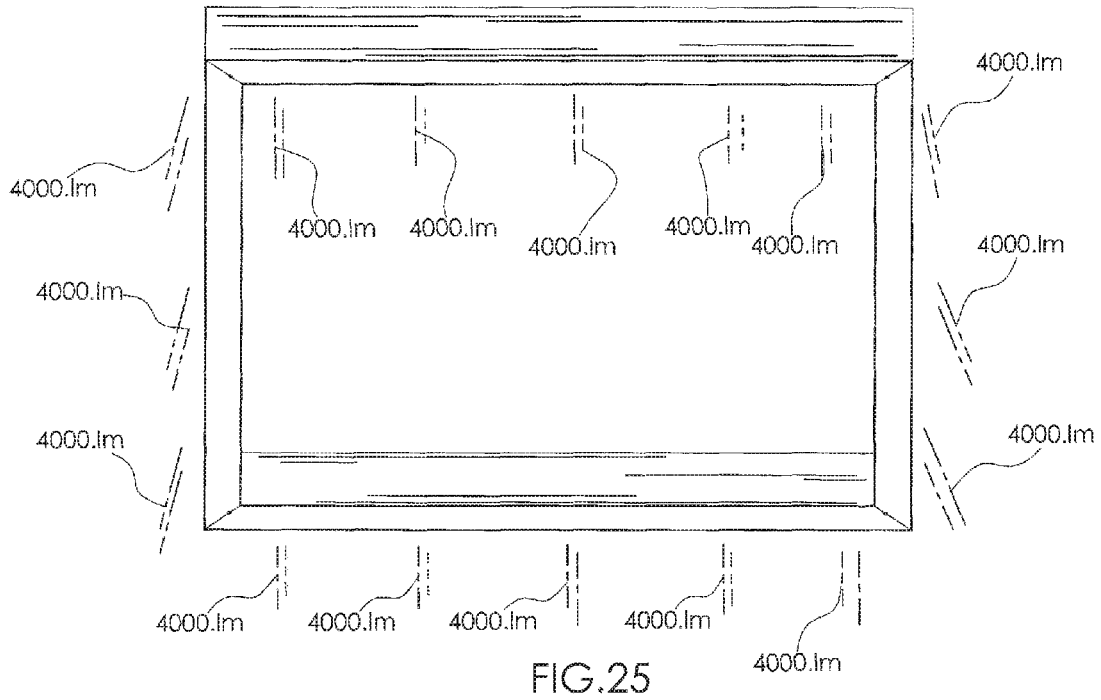

FIG. 25 is a front elevational view of an assembled square lighting fixture using illumination operating structures from either FIG. 16-18 or FIG. 10-12 to build the four linear walls of a square fixture 4000 with only one set of LEDs powered to illuminate only all four exterior rear planar surfaces of the illuminating operating structure, it is built with only a printed circuit board and one set of LEDs which are powered on.

Figure 26:
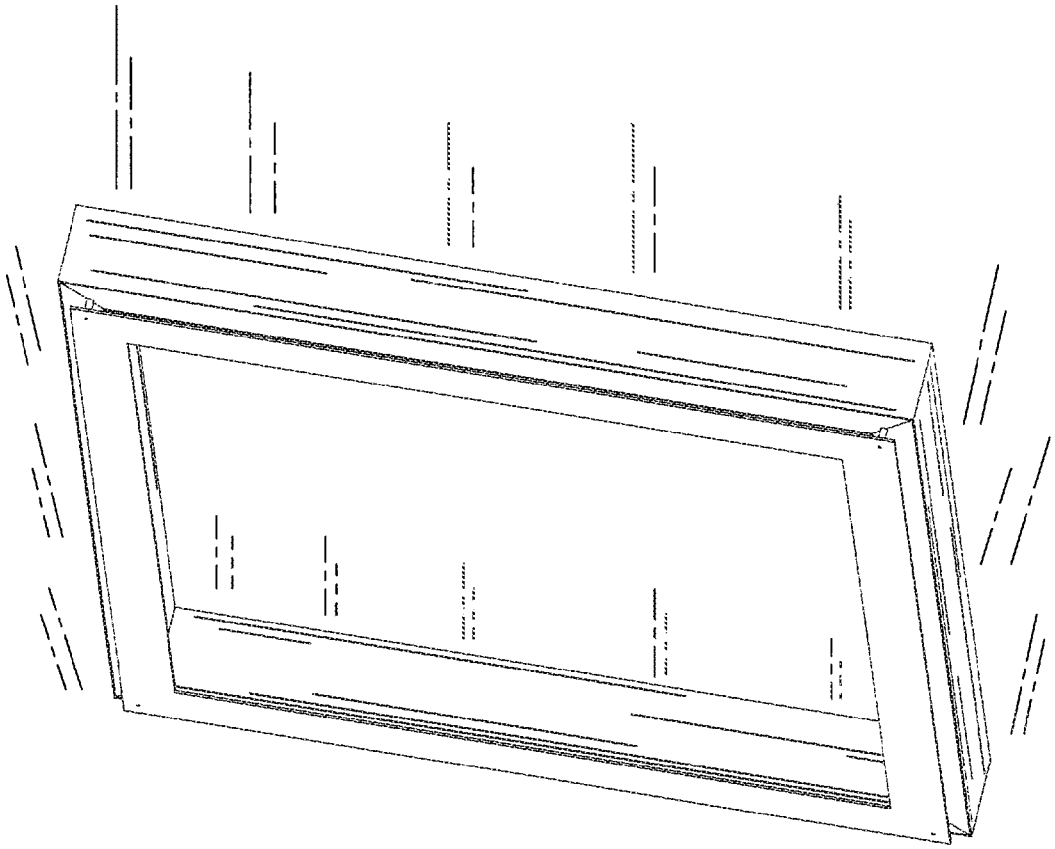
FIG. 26 is a front elevational view of an assembled square lighting fixture using illumination operating structures from either FIGS. 7-9 or FIGS. 13-15 to build the four linear walls of a square fixture with only one set of LEDs powered to illuminate only all four exterior front planar surfaces of the illuminating operating structure, with a lens in front of the front surfaces to create reflection illumination, it is built with only a printed circuit board and one set of LEDs which are powered on LEDs on the exterior front planar surfaces.

FIG. 26 is a front elevational view of an assembled square lighting fixture using illumination operating structures from either FIGS. 7-9 or FIGS. 13-15 to build the four linear walls of a square fixture 4000 with only one set of LEDs powered to illuminate only all four exterior front planar surfaces of the illuminating operating structure, with a lens in front of the front surfaces to create reflection illumination, it is built with only a printed circuit board and one set of LEDs which are powered on LEDs on the exterior front planar surfaces.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A lighting fixture utilizing LEDs for illumination for exterior front planar surfaces and exterior rear planar surfaces or only exterior front planar surfaces or exterior rear planar surfaces of a geometric shaped light, the lighting fixture comprising:

a. an illumination operating structure including a housing having a first sidewall and a parallel oppositely disposed second sidewall on opposite sides of an interior chamber, the first sidewall having an upper end, a lower end, and an interior surface, the second sidewall having an upper end, a lower end, and an interior sidewall, the first sidewall having a first interiorly extending upper shelf extending from the interior surface and the second sidewall having a parallel oppositely disposed second interiorly extending upper shelf extending from the interior sidewall, a first lens having an upper illumination surface through which illumination extends and a first slanted sidewall which ends in a first widened retention end and a second slanted sidewall which ends in a second widened retention end, the first lens press fit placed within the housing so that the widened retention end of the first slanted sidewall rests upon the first interiorly extending upper shelf, and the widened retention end rests upon the second interiorly extending upper shelf the first lens is positioned below the upper end the of first sidewall and below the upper end of the second sidewall, the first sidewall, the second sidewall, the first lens including the upper illumination surface the first slanted leg and widened retention end and second slanted leg and widened retention member the first interiorly extending upper shelf and the second interior extending upper shelf all having a same first longitudinal length;

b. a mirror image second lens press fit retained above the lower end of the first sidewall, above the lower end of the second sidewall, the first sidewall having a third interiorly extending lower shelf and the second sidewall having a parallel oppositely disposed fourth interiorly extending lower shelf, the second lens containing a lower illumination surface through which illumination extends and a first slanted sidewall which ends in a first widened retention end and a second slanted sidewall which ends in a second widened retention end, the second lens is press fit retained within the housing so that the first slanted sidewall of the of the second lens extends toward the first sidewall and the widened retention end rests on the third interiorly extending lower shelf, the second slanted sidewall of the second lens extends toward the second sidewall and the widened retention end rests on the fourth interiorly extending lower shelf, the second lens press fit retained within the interior chamber of the housing so that the illumination surface of the second lens extends within the interior chamber above the lower end of the first sidewall and also above the lower end of the second sidewall, the second lens including the upper illumination surface, the first slanted leg and widened retention end and second slanted leg and widened retention end, the third interiorly extending lower shelf and the fourth interiorly extending lower shelf all having the same first longitudinal length;

c. a first affixation transverse shelf integrally affixed at a first end to the first sidewall and integrally affixed at a second end to the second sidewall, the first affixation transverse shelf having an upper surface and a lower surface a first affixation rail integrally affixed to the upper surface of the first affixation transverse shelf and a second affixation rail integrally affixed to the upper surface of first affixation transverse shelf, and spaced apart from and parallel to the first affixation rail, the first affixation transverse shelf, the first and second affixation rails all having the same first longitudinal length, the first and second affixation rails each having an interior longitudinal groove;

d. a first flat reflector having the same first longitudinal length and affixed into each respective interior longitudinal groove in each of the first affixation rail and the second affixation rail by a multiplicity of affixation members, a first printed circuit board affixed to the first flat reflector, the first printed circuit board having affixed thereto a first multiplicity of spaced apart LEDs facing the first lens;

e. illumination from the first multiplicity of spaced apart LEDs traveling through the first lens;

f. a fifth lower interior shelf extending from the interior surface of first sidewall and above the third lower interior shelf with a first gap between them, a sixth lower interior shelf extending from the interior surface of the second sidewall and above the fourth lower interior shelf with a second gap between them, a first combination third lower interior shelf first gap and fifth lower interior shelf are parallel to a second combination of the fourth lower interior shelf the second gap and sixth lower interior shelf and all having the same first longitudinal length;

g. a second generally "U"-shaped reflector having the same first longitudinal length and having a transverse flat upper wall with a first end extending to a first leg having a first leg section and a second leg section with a transverse end section inserted into and press fit retained in the first gap, the transverse upper wall having a second end extending to a second leg having a first leg section and a second leg section with a transverse end section inserted into and press fit retained in the second gap, the transverse wall of the generally "U"-shaped reflector having a lower surface with a second printed circuit board retained on the lower surface and a second multiplicity of spaced apart LEDs affixed to the second printed circuit board, the second multiplicity of spaced apart LEDs facing the second lens, illumination from the second multiplicity of spaced apart LEDs traveling through the second lens; and h. power to the printed circuit boards and first and second spaced apart LEDs is selected from the group consisting of at least one ballast retained within the interior chamber, the at least one ballast electrically connected to the first printed circuit board and to the second printed circuit board to electrically power the first multiplicity of LEDs and the second multiplicity of LEDs, the at least one ballast electrically connected to a source of power, and a first ballast and a second ballast is retained within the interior chamber with the first ballast electrically connected to the first printed circuit board to electrically power the first multiplicity of LEDs and the first ballast electrically connected to a source of power and the second ballast electrically connected to the second printed circuit board to electrically power the second multiplicity of LEDs and the second ballast electrically connected to a source of power.

2. The lighting fixture in accordance with claim 1, further comprising:

a. the lighting is selected from one of a group having exterior front planar surfaces and exterior rear planar surfaces and having a geometric shape selected from the group consisting of triangular, rectangular, square, pentagonal, hexagonal octagonal and polygonal, where said illumination operating structure has linear first and second sidewalls;

b. said illumination operating structure is selected from the group consisting of:

(i) the first multiplicity of LEDs are white light LEDs and the second multiplicity of LEDs are white light LEDs, (ii) the first multiplicity of LEDs are RGB LEDs and the second multiplicity of LEDs are RGB LEDs, (iii) the first multiplicity of LEDs are white light LEDs and the second multiplicity of LEDs are RGB LEDs, (iv) the first multiplicity of LEDs are RGB LEDs and the second multiplicity of LEDs are white light LEDs;

c. the illumination operating structure is affixed in each respective geometric structure selected from the group consisting of the flat reflector facing a respective exterior front planar surface of each respective geometric structure and the generally "U"-shaped reflector facing a respective exterior rear planar surface of each respective geometric structure, and the flat reflector facing a each respective rear planar surface of each respective geometric structure, and the generally "U"-shaped reflector facing each respective exterior front planar side of each respective geometric structure; and d. the illumination operating structure emits illumination selected from the group consisting of illumination from at least one of both the first multiplicity of LEDs and at least one of the second multiplicity of LEDs identified in elements (b), and the illumination operating structure is oriented selected from each respective one of the two orientations identified in element "c" and the illumination operating structure emits illumination selected from the group consisting of both the at least one of first multiplicity of LEDs and at least one of the second multiplicity of LEDs are powered to create illumination though both at least one of the exterior front planar surfaces and at least one of the exterior rear planar surfaces, one of the first multiplicity of LEDs and the second multiplicity of LEDs are powered to create illumination through only at least one of the exterior front planar surfaces, and only one of the first multiplicity of LEDs and the second multiplicity of LEDs are powered to create illumination only through the at least one exterior rear planar surfaces.

3. The lighting fixture in accordance with claim 1, further comprising:

a. the lighting is selected from one of a group having arcuate exterior sides and arcuate interior sides and having a geometric shape selected from the group consisting round, oval and elliptical, where said illumination operating structure has arcuate first and second sidewalls;

b. said illumination operating structure is selected from the group consisting of:

(i) the first multiplicity of LEDs are white light LEDs and the second multiplicity of LEDs are white light LEDs, (ii) the first multiplicity of LEDs are RGB LEDs and the second multiplicity of LEDs are RGB LEDs, (iii) the first multiplicity of LEDs are white light LEDs and the second multiplicity of LEDs are RGB LEDs, (iv) the first multiplicity of LEDs are RGB LEDs and the second multiplicity of LEDs are white light LEDs;

c. the illumination operating structure is affixed in each respective geometric structure selected from the group consisting of the flat reflector facing each respective exterior front planar surface of each respective geometric structure and the generally "U"-shaped reflector faces a respective exterior rear planar surface of each respective geometric structure and the flat reflector facing each respective exterior rear planar surface of each respective geometric structure and the generally "U"-shaped reflector faces a respective exterior front planar surface of each respective geometric structure; and d. the illumination operating structure emits illumination selected from the group consisting of illumination from both at least one of the first multiplicity of LEDs and at least one of the second multiplicity of LEDs identified in element (b), and the illumination operating structure is oriented selected from each respective one of the two orientations identified in element "c" and the illumination operating structure emits illumination selected from the group consisting of both at least one of the first multiplicity of LEDs and at least one of at least one of the second multiplicity of LEDs are powered to create illumination though both at least one of the exterior front planar surfaces and exterior rear planar surfaces, only one of the first multiplicity of LEDs and the second multiplicity of LEDs are powered to create illumination only through exterior at least one exterior front planar surface and only one of the first multiplicity of LEDs and the second multiplicity of LEDs are powered to create illumination only through tat least one exterior rear planar surfaces.

4. A lighting fixture utilizing LEDs for illumination of selected exterior front planar surfaces and exterior rear planar surfaces of a geometric shaped light, the lighting fixture comprising:

a. an illumination operating structure including a, the lighting fixture comprising:

a. an illumination operating structure including a housing having a first sidewall and a parallel oppositely disposed second sidewall on opposite sides of an interior chamber, the first sidewall having an upper end, a lower end, and a first interior surface, the second sidewall having an upper end, a lower end, and a second interior surface, a first lens having a first illumination surface located within the interior chamber and adjacent the upper ends of the first and second sidewalls and a pair of legs extending from opposite ends of the first illumination surface into the interior chamber and respectively press fit retained adjacent a respective first interior surface and a second interior surface, a second lens having a second illumination surface located within the interior chamber adjacent the lower ends of the first and second sidewalls and a pair of legs extending from opposite ends of the second illumination surface into the interior chamber and respectively press fit retained adjacent a respective first interior surface and second interior surface, the first illumination surface and second illumination surface parallel to each other;

b. a first flat reflector affixed within the interior chamber at a location spaced apart from the first illumination surface, a first printed circuit board affixed to the first flat reflector, the first printed circuit board having affixed thereto a first multiplicity of spaced apart LEDs facing the first reflector;

c. illumination from the first multiplicity of spaced apart LEDs travels through the first illumination surface of the first lens;

d. a second generally "U"-shaped reflector having a transverse flat upper wall with a first end extending to a first leg and a second end extending to a second leg, the first and second legs extending into the interior chamber and respectively retained adjacent the first interior surface and the second interior surface, the transverse flat upper wall having an interior surface facing the illumination surface of the second lens, a second printed circuit board retained on the lower surface, a second multiplicity of spaced apart LEDs affixed to the second printed circuit board, the second multiplicity of spaced apart LEDs facing the second illumination surface of the second lens, illumination from the second multiplicity of spaced apart LEDs traveling through the second illumination surface; and e. power to the printed circuit boards and first and second spaced apart LEDs is selected from the group consisting of at least one ballast retained within the interior chamber, the at least one ballast electrically connected to the first printed circuit board and to the second printed circuit board to electrically power the first multiplicity of LEDs and the second multiplicity of LEDs, the at least one ballast electrically connected to a source of power, and a first ballast and a second ballast is retained within the interior chamber with the first ballast electrically connected to the first printed circuit board to electrically power the first multiplicity of LEDs and the first ballast electrically connected to a source of power and the second ballast electrically connected to the second printed circuit board to electrically power the second multiplicity of LEDs and the second ballast electrically connected to a source of power.

5. The lighting fixture in accordance with claim 4, further comprising:

a. the lighting is selected from one of a group having exterior front planar surfaces and exterior rear planar surfaces and having a geometric shape selected from the group consisting of triangular, rectangular, square, pentagonal, hexagonal octagonal and polygonal, where said illumination operating structure has linear first and second sidewalls;

b. said illumination operating structure is selected from the group consisting of:

(i) the first multiplicity of LEDs are white light LEDs and the second multiplicity of LEDs are white light LEDs, (ii) the first multiplicity of LEDs are RGB LEDs and the second multiplicity of LEDs are RGB LEDs, (iii) the first multiplicity of LEDs are white light LEDs and the second multiplicity of LEDs are RGB LEDs, (iv) the first multiplicity of LEDs are RGB LEDs and the second multiplicity of LEDs are white light LEDs;

c. the illumination operating structure is affixed in each respective geometric structure selected from the group consisting of the flat reflector facing each respective exterior front planar surface of each respective geometric structure and the generally "U"-shaped reflector faces a respective exterior rear planar surface of each respective geometric structure and the flat reflector facing each respective exterior rear planar surface of each respective geometric structure and the generally "U"-shaped reflector facing a respective exterior front planar surface of each respective geometric structure; and d. the illumination operating structure emits illumination selected from the group consisting of illumination from both the first multiplicity of LEDs and the second multiplicity of LEDs identified in element (b), and the illumination operating structure is oriented selected from each respective one of the two orientations identified in element "c" and the illumination operating structure emits illumination selected from the group consisting of both the first multiplicity of LEDs and the second multiplicity of LEDs are powered to create illumination though both the exterior front planar surfaces and exterior rear planar surfaces of the first multiplicity of LEDs and the second multiplicity of LEDs are powered to create illumination through only the exterior front planar surfaces and only one of the first multiplicity of LEDs and the second multiplicity of LEDs are powered to create illumination only through the exterior rear planar surfaces.

6. The lighting fixture in accordance with claim 4, further comprising:

a. the lighting is selected from one of a group having arcuate exterior sides and arcuate interior sides and having a geometric shape selected from the group consisting round, oval and elliptical, where said illumination operating structure has arcuate first and second sidewalls;

b. said illumination operating structure is selected from the group consisting of:

(i) the first multiplicity of LEDs are white light LEDs and the second multiplicity of LEDs are white light LEDs, (ii) the first multiplicity of LEDs are RGB LEDs and the second multiplicity of LEDs are RGB LEDs, (iii) the first multiplicity of LEDs are white light LEDs and the second multiplicity of LEDs are RGB LEDs, (iv) the first multiplicity of LEDs are RGB LEDs and the second multiplicity of LEDs are white light LEDs;

c. the illumination operating structure is affixed in each respective geometric structure selected from the group consisting of the flat reflector facing each respective exterior front planar surface of each respective geometric structure and the generally "U"-shaped reflector faces a respective exterior rear planar surface of each respective geometric structure, and the flat reflector facing each respective exterior rear planar surface of each respective geometric structure and the generally "U"-shaped reflector faces a respective exterior front planar surface of each respective geometric structure; and d. the illumination operating structure emits illumination selected from the group consisting of illumination from both the first multiplicity of LEDs and the second multiplicity of LEDs identified in element (b), and the illumination operating structure is oriented selected from each respective one of the two orientations identified in element "c" and the illumination operating structure emits illumination selected from the group consisting of both the first multiplicity of LEDs and the second multiplicity of LEDs are powered to create illumination though both the exterior front planar surfaces and exterior rear planar surfaces and only one of the first multiplicity of LEDs and the second multiplicity of LEDs are powered to create illumination through only the exterior front planar surfaces and only one of the first multiplicity of LEDs and the second multiplicity of LEDs are powered to create illumination only through the exterior rear planar surfaces.

7. A lighting fixture utilizing LEDs for illumination of selected exterior front planar surfaces and exterior rear planar surfaces of a geometric shaped light, the lighting fixture comprising:

a. an illumination operating structure including a housing having a first sidewall and a parallel oppositely disposed second sidewall on opposite sides of an interior chamber, the first sidewall having an upper end, a lower end, and a first interior surface, the second sidewall having an upper end, a lower end, and a second interior surface, a first lens having a first illumination surface within the interior chamber and located adjacent the upper end of the first and second sidewalls and a pair of legs extending from opposite ends of the first illumination surface into the interior chamber and respectively press fit retained adjacent a respective first interior surface and a second interior surface, a second lens having a second illumination surface within the interior chamber and having a second illumination surface located adjacent the lower ends of the first and second sidewalls and a pair of legs extending from opposite ends of the second illumination surface into the interior chamber and respectively press fit retained adjacent a respective first interior surface and second interior surface, the first illumination surface and the second illumination surface parallel to each other;

b. a first generally "U"-shaped reflector within the interior chamber having a transverse flat upper wall with a first end extending to a first leg and a second end extending to a second leg, the first and second legs extending into the interior chamber and respectively retained adjacent the first interior surface and the second interior surface, the transverse flat upper wall having an interior surface facing the illumination surface of the first lens, a first printed circuit board retained on the upper surface, a first multiplicity of spaced apart LEDs affixed to the first printed circuit board, the first multiplicity of spaced apart LEDs facing the first illumination surface of the first lens, illumination from the first multiplicity of spaced apart LEDs traveling through the first illumination surface;

c. a second flat reflector affixed within the interior chamber at a location spaced apart from the second illumination surface, a second printed circuit board affixed to the second flat reflector, the second printed circuit board having affixed thereto a second multiplicity of spaced apart LEDs facing the second lens;

d. illumination from the second multiplicity of spaced apart LEDs travels through the second illumination surface of the second lens; and e. power to the printed circuit boards and first and second spaced apart LEDs is selected from the group consisting of at least one ballast retained within the interior chamber, the at least one ballast electrically connected to the first printed circuit board and to the second printed circuit board to electrically power the first multiplicity of LEDs and the second multiplicity of LEDs, the at least one ballast electrically connected to a source of power, and a first ballast and a second ballast is retained within the interior chamber with the first ballast electrically connected to the first printed circuit board to electrically power the first multiplicity of LEDs and the first ballast electrically connected to a source of power and the second ballast electrically connected to the second printed circuit board to electrically power the second multiplicity of LEDs and the second ballast electrically connected to a source of power.

8. The lighting fixture in accordance with claim 7, further comprising:

a. the lighting is selected from one of a group having linear exterior sides linear interior sides and having a geometric shape selected from the group consisting of triangular, rectangular, square, pentagonal, hexagonal octagonal and polygonal, where said illumination operating structure has linear first and second sidewalls;

b. said illumination operating structure is selected from the group consisting of:

(i) the first multiplicity of LEDs are white light LEDs and the second multiplicity of LEDs are white light LEDs, (ii) the first multiplicity of LEDs are RGB LEDs and the second multiplicity of LEDs are RGB LEDs, (iii) the first multiplicity of LEDs are white light LEDs and the second multiplicity of LEDs are RGB LEDs, (iv) the first multiplicity of LEDs are RGB LEDs and the second multiplicity of LEDs are white light LEDs;

c. the illumination operating structure is affixed in each respective geometric structure selected from the group consisting of the flat reflector facing each respective exterior front planar surface of each respective geometric structure and the generally "U"-shaped reflector facing an exterior rear planar surfaces a respective interior side of each respective geometric structure, and the flat reflector facing each respective exterior front planar surface of each respective geometric structure, and the generally "U"-shaped reflector facing respective exterior front planar surface of each respective geometric structure; and d. the illumination operating structure emits illumination selected from the group consisting of illumination from both the first multiplicity of LEDs and the second multiplicity of LEDs identified in element (b), and the illumination operating structure is oriented selected from each respective one of the two orientations identified in element "c" and the illumination operating structure emits illumination selected from the group consisting of both the first multiplicity of LEDs and the second multiplicity of LEDs are powered to create illumination though both the exterior front planar surfaces and exterior rear planar surfaces, only one of the first multiplicity of LEDs and the second multiplicity of LEDs are powered to create illumination through only the exterior front planar surfaces and only one of the first multiplicity of LEDs and the second multiplicity of LEDs are powered to create illumination only through the exterior rear planar sidewalls.

9. The lighting fixture in accordance with claim 7, further comprising:

a. the lighting is selected from one of a group having arcuate exterior sides and arcuate interior sides and having a geometric shape selected from the group consisting round, oval and elliptical, where said illumination operating structure has arcuate first and second sidewalls;

b. said illumination operating structure is selected from the group consisting of:

(i) the first multiplicity of LEDs are white light LEDs and the second multiplicity of LEDs are white light LEDs, (ii) the first multiplicity of LEDs are RGB LEDs and the second multiplicity of LEDs are RGB LEDs, (iii) the first multiplicity of LEDs are white light LEDs and the second multiplicity of LEDs are RGB LEDs, (iv) the first multiplicity of LEDs are RGB LEDs and the second multiplicity of LEDs are white light LEDs;

c. the illumination operating structure is affixed in each respective geometric structure selected from the group consisting of the flat reflector facing each respective exterior front planar surface of each respective geometric structure and the generally "U"-shaped reflector faces a respective exterior rear planar surface of each respective geometric structure, and the flat reflector facing each respective exterior rear planar surface of each respective geometric structure and the generally "U"-shaped reflector facing a respective exterior front planar surface of each respective geometric structure; and d. the illumination operating structure emits illumination selected from the group consisting of illumination from both the first multiplicity of LEDs and the second multiplicity of LEDs identified in element (b), and the illumination operating structure is oriented selected from each respective one of the two orientations identified in element "c" and the illumination operating structure emits illumination selected from the group consisting of both the first multiplicity of LEDs and the second multiplicity of LEDs are powered to create illumination though both the exterior front planar surfaces and exterior rear planar surfaces, only one of the first multiplicity of LEDs and the second multiplicity of LEDs are powered to create illumination through only the exterior front planar surfaces and only one of the first multiplicity of LEDs and the second multiplicity of LEDs are powered to create illumination only through the exterior rear planar surfaces.

* * * * *